US007460137B2

(12) United States Patent
Miyagawa

(10) Patent No.: US 7,460,137 B2
(45) Date of Patent: Dec. 2, 2008

(54) DISPLAY DEVICE

(75) Inventor: Keisuke Miyagawa, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 606 days.

(21) Appl. No.: 11/100,898

(22) Filed: Apr. 7, 2005

(65) Prior Publication Data

US 2005/0231449 A1 Oct. 20, 2005

(30) Foreign Application Priority Data

Apr. 15, 2004 (JP) ..... 2004-119893

(51) Int. Cl.
*G09G 5/10* (2006.01)

(52) U.S. Cl. ..... 345/690

(58) Field of Classification Search ..... 345/100, 345/204, 690, 82, 98, 89, 107, 76, 75.2, 77, 345/473; 219/21.83; 348/615, 674, 65, 187; 428/131; 702/117
See application file for complete search history.

(56) References Cited

U.S. PATENT DOCUMENTS 4,695,884 A * 9/1987 Anastassiou et al. ..... 348/615
5,247,154 A * 9/1993 Ahmed ..... 219/121.83
5,351,201 A * 9/1994 Harshbarger et al. ..... 348/187
5,516,572 A * 5/1996 Roe ..... 428/131
5,572,444 A * 11/1996 Lentz et al. ..... 702/117
5,910,793 A * 6/1999 Rogovin et al. ..... 345/100
6,388,649 B1 * 5/2002 Tanaka et al. ..... 345/89
6,633,343 B2 * 10/2003 Ito et al. ..... 348/674
7,006,113 B2 * 2/2006 Yamamoto et al. ..... 345/690
7,027,054 B1 * 4/2006 Cheiky et al. ..... 345/473
7,106,368 B2 9/2006 Daiku et al.
2001/0033263 A1 * 10/2001 Yamada et al. ..... 345/89
2001/0052929 A1 * 12/2001 Abe ..... 348/65
2002/0140641 A1 * 10/2002 Mikami et al. ..... 345/75.2
2002/0145584 A1 * 10/2002 Waterman ..... 345/98
2004/0085269 A1 * 5/2004 Mikami et al. ..... 345/76
2004/0178974 A1 * 9/2004 Miller et al. ..... 345/82
2005/0024353 A1 * 2/2005 Amundson et al. ..... 345/204

(Continued)

FOREIGN PATENT DOCUMENTS

CN 1383321 A 12/2002

(Continued)

OTHER PUBLICATIONS

Office Action re Chinese patent application No. CN 200510066624.4, dated May, 23, 2008 (with English translation).

*Primary Examiner*—Prabodh Dharia
(74) *Attorney, Agent, or Firm*—Cook Alex Ltd.

(57) ABSTRACT

A display device, where the power consumption of a display panel can be reduced by controlling a display time rate, including an average gray scale calculator obtaining an average gray scale by averaging a gray scale of each pixel over an entire screen of one frame and for outputting an average gray scale signal, a display time rate table outputting a magnification signal for reducing the display time rate when the average gray scale exceeds a certain value in accordance with the average gray scale signal, and a timing signal generator generating an erase start signal for erasing the digital video signal written to the each pixel in accordance with the magnification signal.

12 Claims, 26 Drawing Sheets

U.S. PATENT DOCUMENTS

| | | | | |
|---|---|---|---|---|
| 2005/0259089 | A1* | 11/2005 | Yamazaki et al. | 345/204 |
| 2005/0280662 | A1* | 12/2005 | Tognoni et al. | 345/690 |
| 2006/0139311 | A1* | 6/2006 | Zehner et al. | 345/107 |
| 2007/0200803 | A1* | 8/2007 | Kimura | 345/76 |

FOREIGN PATENT DOCUMENTS

| | | | |
|---|---|---|---|
| EP | 1 103 946 | A2 | 5/2001 |
| EP | 1 253 780 | A2 | 10/2002 |
| EP | 1 921 846 | A2 | 5/2008 |
| JP | 05-341728 | | 12/1993 |
| JP | 2001-147667 | | 5/2001 |
| JP | 2001-343933 | | 12/2001 |
| WO | WO 03/044765 | A2 | 5/2003 |

* cited by examiner

--Prior Art--

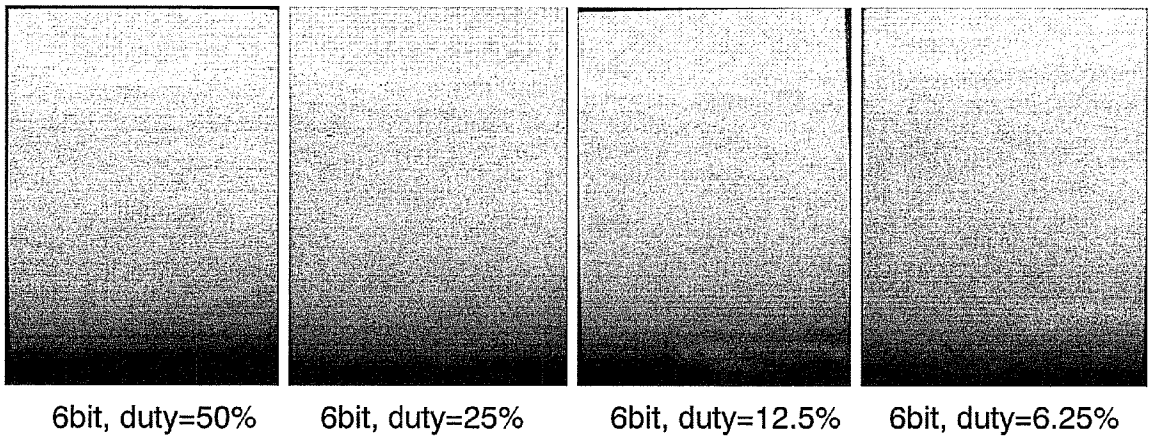
FIG. 14A
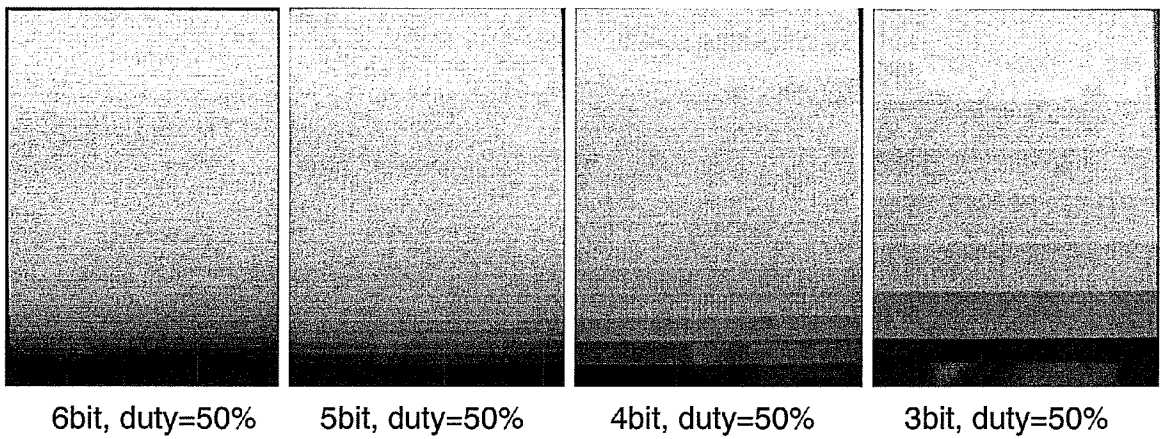
FIG. 14B --Prior Art--

--Prior Art--

--Prior Art--

--Prior Art--

--Prior Art--

DISPLAY DEVICE

BACKGROUND OF THE INVENTION

1. Field of the Invention

The present invention relates to a display device capable of easily displaying gray scale images using an EL element or the like, and an electronic apparatus having the display device.

2. Description of the Related Art

In recent years, a display device using a light emitting element typified by an electro luminescence element (hereinafter referred to as an EL element) has been actively developed. The EL element includes the one utilizing luminescence generated from an excited singlet state and the one utilizing luminescence generated from an excited triplet state. The EL element generally adopts a stacked structure where a light emitting layer is sandwiched between a pair of electrodes (anode and cathode). For example, there is a stacked structure of a hole transporting layer, a light emitting layer, and an electron transporting layer. Also known is a stacked structure where a hole injection layer, a hole transporting layer, a light emitting layer, and an electron transporting layer are stacked, or a hole injection layer, a hole transporting layer, a light emitting layer, an electron transporting layer, and an electron injection layer are stacked in this order on an anode (see Patent Document 1, for example).

[Patent Document 1] Japanese Patent Laid-Open No. 2001-343933

As an LED driving device capable of adjusting the luminance of a light emitting element such as an LED to display gray scale images, suggested was a display device capable of varying the luminance of an LED display array by changing an LED emission time of the LED display array in one scanning period, namely by changing duty ratio (see Patent Document 2, for example).

[Patent Document 2] Japanese Patent Laid-Open No. H5-341728

In the aforementioned conventional display device, the duty ratio of an LED varies in accordance with external luminance data, therefore, gray scale images are displayed by controlling the external luminance data and light emission time rate is adjusted by varying the duty ratio of a light emitting data pulse. In the case of such an LED display device, pulse time interval of light emission data is equal to each other in all fields. Thus, the number of gray scale levels is required to be equal to that of fields and the number of fields is required to be increased to increase the number of gray scale levels, resulting in limited number of gray scale levels that can be displayed.

On the other hand, as a display device capable of multi-gray scale displaying using the aforementioned EL element, there is a known display device adopting a digital gray scale method and a time gray scale method (Patent Document 1).

The time gray scale method is a method of displaying gray scale images by controlling an EL element emission time, which will be described with reference to FIGS. 23 to 26. As shown in FIGS. 23 and 24, an EL display device has a pixel portion 101 including a pixel 105 that is arranged in matrix using a TFT (thin film transistor) on a substrate, and a source signal line driver circuit 102, a writing gate signal line driver circuit 103, and an erasing gate signal line driver circuit 104 that are disposed at the periphery of the pixel portion 101. The source signal line driver circuit 102 has a shift register 102*a*, a latch 102*b*, and a latch 102*c*.

The pixel portion 101 has source signal lines (S1 to Sx) connected to the latch 102*c* of the source signal line driver circuit 102, power supply lines (V1 to Vx), writing gate signal lines (Ga1 to Gay) connected to the writing gate signal line driver circuit 103, and erasing gate signal lines (Ge1 to Gey) connected to the erasing gate signal line driver circuit 104. Each of the signal lines is connected to the corresponding pixel 105 arranged in matrix. Note that reference numeral 106 denotes a time division gradation data signal generation circuit.

The pixel 105 has, as shown in FIG. 25, a switching TFT 107, an EL driving TFT 108 connected to an EL element 110, an erasing TFT 109, and a capacitor 112. A gate electrode of the switching TFT 107 is connected to a writing gate signal line Ga, one of a source region and a drain region thereof is connected to a source signal line S, and the other is connected to a gate electrode of the EL driving TFT 108, the capacitor 112 in each pixel, and a source region or a drain region of the erasing TFT 109. The capacitor 112 is provided in order to hold a gate voltage of the EL driving TFT 108 when the switching TFT 107 is off (non-selected state).

One of a source region and a drain region of the EL driving TFT 108 is connected to a power supply line V and the other is connected to the EL element 110. The power supply line V is connected to the capacitor 112. The source region or the drain region of the erasing TFT 109, which is not connected to the switching TFT 107, is connected to the power supply line V, and a gate electrode thereof is connected to a gate signal line Ge.

The operation and gray scale display of the EL display device are hereinafter described with reference to FIG. 26. When a writing selection signal is inputted from the writing gate signal line driver circuit 103, the switching TFTs 107 in all the pixels connected to the writing gate signal line Ga1 of the first row are turned on. At the same time, the first bit digital data "0" or "1" of a video signal that is converted into a digital signal is inputted to the source signal lines S1 to Sx from the latch 102*c*. This digital data is inputted to the gate electrode of the EL driving TFT 108 through the switching TFT 107. When the digital data is "1", the EL driving TFT 108 is turned on and the EL element 110 emits light. Meanwhile, when the digital data is "0", the EL driving TFT 108 is turned off and the EL element 110 emits no light.

As set forth above, when the digital data is inputted to the pixels of the first row, the EL element emits light or no light, thereby the pixels of the first row display images. Here, a display period of a pixel is denoted by Tr, a display period of a pixel to which the first bit digital data is inputted is denoted by Tr1, and display periods by the digital data of the subsequent bits are sequentially denoted by Tr2, Tr3 . . . as shown in FIG. 26.

When the input of the writing selection signal to the writing gate signal line Ga1 is completed, a writing selection signal is similarly inputted to the writing gate signal line Ga2. Then, the switching TFTs 107 in all the pixels connected to the writing gate signal line Ga2 are turned on, and the first bit digital data is inputted to the pixels of the second row from the source signal lines S1 to Sx. A writing period Ta1 is a period where writing selection signals are sequentially inputted to all the writing gate signal lines (Ga1 to Gay) to select all the writing gate signal lines and the first bit digital data is inputted to the pixels of all the rows.

On the other hand, before the first bit digital data is inputted to the pixels of all the rows, that is, before the completion of the writing period Ta1, an erasing selection signal is inputted to the erasing gate signal line Ge1 from the erasing gate signal line driver circuit 104 at the same time as the input of the first bit digital data to the pixels. Then, the erasing TFTs 109 in all the pixels (pixels of the first row) connected to the erasing gate signal line Ge1 are turned on, and power supply potentials of the power supply lines (V1 to Vx) are supplied to the gate electrodes of the EL driving TFTs 108, thereby the EL driving TFTs 108 are turned off. Accordingly, the power supply potentials are not supplied to pixel electrodes of the EL elements 110, and all the EL elements 110 in the pixels of the first row emit no light, thus the pixels of the first row display no image. A non-display period where the pixels display no image after the data is erased is denoted by Td as shown in the drawing, and a non-display period of the first row is denoted by Td1.

Data writing and erasing are performed in the subsequent row similarly to the first row, thereby the first bit digital data of the pixels of all the rows is erased. An erasing period where the first bit digital data of the pixels of all the rows is erased is denoted by Te1 as shown in the drawing. An erasing period of the second bit digital data is denoted by Te2.

The operations of displaying, erasing, and non-displaying are thus repeated until the n-th bit digital data is inputted to the pixels, and a displaying period Tr and a non-displaying period Td alternately appear. When all the display periods (Tr1 to Trn) are completed, one image, namely an image of one frame can be displayed.

In the EL display device performing the aforementioned operations, the length of the display period Tr is set such that Tr1:Tr2: . . . Trn=$2^0$:$2^1$: . . . $2^{(n-1)}$ to display gray scale images. By combining the display periods, a desired level gray scale display selected from $2^n$-level gray scale can be performed. The gray scale level of an image displayed in a pixel in one frame is determined by the sum of display periods where an EL element emits light in the frame. For example, in the case of n=8 (256-level gray scale), on the assumption that luminance when a pixel emits light in all the display periods is 100%, a luminance of 1% is achieved when the pixel emits light in Tr1 and Tr2, while a luminance of 60% is achieved when the pixel emits light in Tr3, Tr5, and Tr8.

In other words, on the assumption that display time/(display time+non-display time)=display time rate and display time rate at the maximum gray scale level is the maximum value of the display time rate in one frame period, gray scale images are displayed with the maximum value of the display time rate fixed as shown in FIG. 9. When the maximum value of the display time rate is fixed, the power consumption of a display means (EL display panel) increases with the increase in gray scale levels as described below. FIG. 14B is an experimental result showing that the number of display gray scale levels decreases if luminance is varied by reducing gray scale level. In FIG. 14B, bit corresponds to the number of gray scale levels whereas duty corresponds to the display time rate. If a pixel constituting a display means includes an EL element that is a light emitting element, the display time and the non-display time are equivalent to a light emission time and a non-light emission time, and thus the display time rate in FIG. 9 is a light emission time rate.

SUMMARY OF THE INVENTION

In view of the fact that the display time rate increases with the increase in the gray scale level, the invention provides a display device having a gray scale control circuit that can prevent the increase in the power consumption of a display means such as an EL display panel and a liquid crystal display panel even when gray scale level increases.

A display device of the invention has an average gray scale calculator for obtaining an average gray scale level of a video signal of one frame, a display time rate table for outputting a gray scale control signal based on the average gray scale level to reduce the display time rate of a pixel, and a display means where a gray scale level of the pixel is controlled based on an output of the display time rate table. When a gray scale level is controlled in accordance with the average gray scale level of a video signal of one frame, display time rate can be reduced, leading to reduction in the power consumption of the display means.

When displaying an image with a high average gray scale level, the luminance of the entire screen increases and power consumption increases. However, power consumption can be suppressed to a certain value by decreasing the display time rate when the average gray scale level of a video signal of one frame exceeds a certain value. Suppressing the power consumption to a certain value leads to reduction in the power consumption of a display means.

BRIEF DESCRIPTION OF THE DRAWINGS

FIG. 14A shows an image example of a display device of the invention, and FIG. 14B shows an image example of a conventional display device.

DETAILED DESCRIPTION OF THE INVENTION

EMBODIMENT MODE

In the invention, both of a digital video signal and an analog video signal can be used as a video signal inputted to a display means such as an EL display panel and a liquid crystal display panel. An example of a digital video signal obtained by digitalizing a video signal inputted to a display means is hereinafter described, and an example of an analog video signal will be described later.

Figure 1:
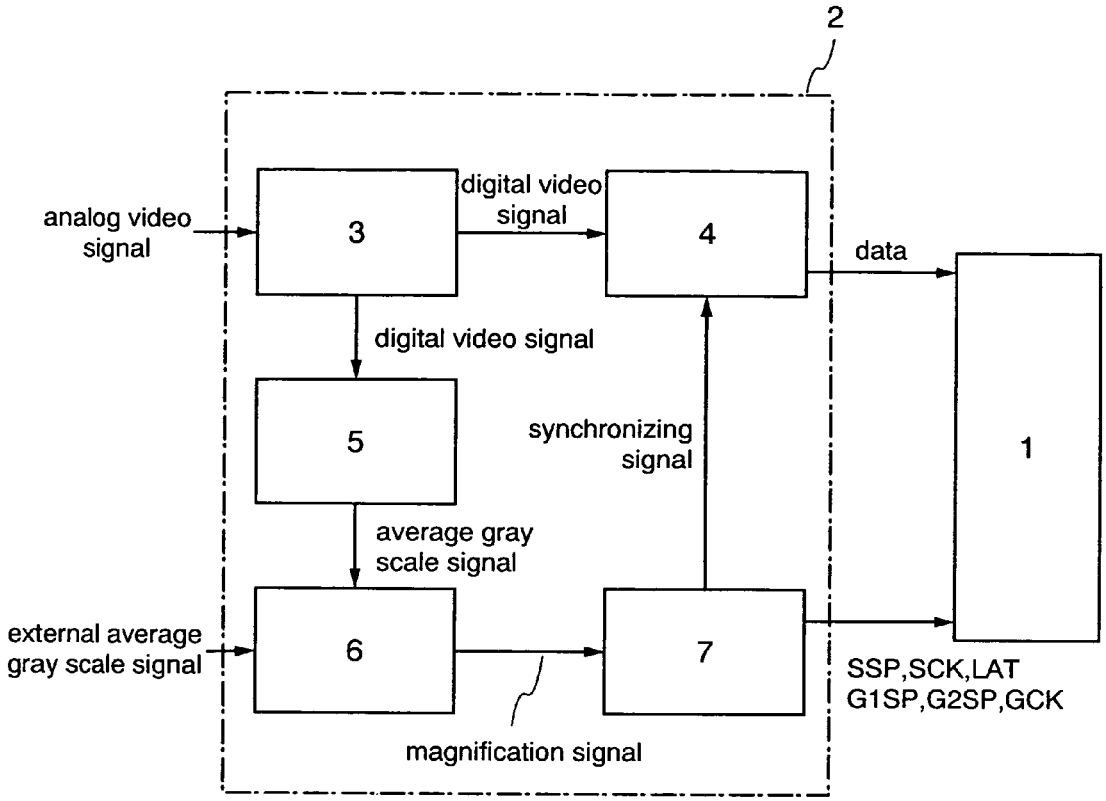
FIG. 1 is a block diagram showing a gray scale control circuit of a display device of the invention.

As shown in FIG. 1, a display device of the invention has a display means 1 such as an EL display panel and a liquid crystal display panel and a gray scale control circuit 2 for controlling the gray scale level of the display means 1. The gray scale control circuit 2 has an A/D converter 3 for converting an analog video signal into a digital video signal, a data controller 4 for taking a digital video signal, one frame average gray scale calculating portion 5 for calculating and outputting an average gray scale level obtained by averaging the gray scale level of a digital video signal of each pixel over the entire screen of one frame, a display time rate table 6 for generating a magnification signal described later in accordance with the average gray scale signal, and a timing signal generator 7 to which the magnification signal is inputted. The gray scale level of the display means 1 is controlled by the output data of the data controller 4 and the timing signal generator 7.

In the gray scale control circuit 2, when an analog video signal is converted into a digital video signal in the A/D converter 3, the digital video signal is inputted to the data controller 4 and converted into data corresponding to the display means 1 therein, and the data is outputted to the display means 1 in synchronization with a synchronizing signal from the timing signal generator 7.

The data controller 4 includes a frame memory, holds digital video signals of one frame in this frame memory, and outputs a gray scale bit corresponding to each subframe described later to the display means 1 as data. The one frame average gray scale calculating portion 5 calculates an average gray scale level obtained by averaging the gray scale level of a digital video signal of each pixel over the entire screen of one frame. Then, as described later, the sum of the gray scale levels of all pixels is calculated by an adder and a memory, and the most significant few bits, for example the most significant four bits are outputted as average gray scale signals. A circuit example of the one frame average gray scale calculating portion 5 will be described later.

The display time rate table 6 (hereinafter referred to as the table 6) is a kind of look-up table that has an input/output relation determined by an average gray scale signal inputted from the one frame average gray scale calculating portion 5 or an external device. The table 6 has a hardware configuration including memories such as a ROM and a RAM, and stores, for example, data shown in Table 1. It is needless to say that the data of the table 6 is not limited to the one shown in Table 1, and it may be set arbitrarily depending on power consumption and desired image quality. The inputted most significant four bits obtained by calculating in the one frame average gray scale calculating portion 5 are outputted after being converted into three bits based on the data shown in Table 1. In Table 1, gray scale denotes the average gray scale level of a video signal of one frame, while magnification denotes the attenuation rate of the holding time of the frame memory.

TABLE 1

| Gray scale | Magnification | Input | Output |
|---|---|---|---|
| 0 | 1.00 | 0 0 0 0 | 1 1 1 |
| 1 | 1.00 | 0 0 0 0 | 1 1 1 |
| 2 | 1.00 | 0 0 0 0 | 1 1 1 |
| 3 | 1.00 | 0 0 0 0 | 1 1 1 |
| 4 | 1.00 | 0 0 0 1 | 1 1 1 |
| 5 | 1.00 | 0 0 0 1 | 1 1 1 |
| 6 | 1.00 | 0 0 0 1 | 1 1 1 |
| 7 | 1.00 | 0 0 0 1 | 1 1 1 |
| 8 | 1.00 | 0 0 1 0 | 1 1 1 |
| 9 | 1.00 | 0 0 1 0 | 1 1 1 |
| 10 | 1.00 | 0 0 1 0 | 1 1 1 |
| 11 | 1.00 | 0 0 1 0 | 1 1 1 |
| 12 | 1.00 | 0 0 1 1 | 1 1 1 |
| 13 | 1.00 | 0 0 1 1 | 1 1 1 |
| 14 | 1.00 | 0 0 1 1 | 1 1 1 |
| 15 | 1.00 | 0 0 1 1 | 1 1 1 |
| 16 | 1.00 | 0 1 0 0 | 1 1 1 |
| 17 | 1.00 | 0 1 0 0 | 1 1 1 |
| 18 | 1.00 | 0 1 0 0 | 1 1 1 |
| 19 | 1.00 | 0 1 0 0 | 1 1 1 |
| 20 | 1.00 | 0 1 0 1 | 1 1 1 |
| 21 | 1.00 | 0 1 0 1 | 1 1 1 |
| 22 | 1.00 | 0 1 0 1 | 1 1 1 |
| 23 | 1.00 | 0 1 0 1 | 1 1 1 |
| 24 | 1.00 | 0 1 1 0 | 1 1 1 |
| 25 | 1.00 | 0 1 1 0 | 1 1 1 |
| 26 | 1.00 | 0 1 1 0 | 1 1 1 |
| 27 | 1.00 | 0 1 1 0 | 1 1 1 |
| 28 | 1.00 | 0 1 1 1 | 1 1 1 |
| 29 | 1.00 | 0 1 1 1 | 1 1 1 |
| 30 | 1.00 | 0 1 1 1 | 1 1 1 |
| 31 | 1.00 | 0 1 1 1 | 1 1 1 |
| 32 | 1.00 | 1 0 0 0 | 1 1 1 |
| 33 | 0.97 | 1 0 0 0 | 1 1 0 |
| 34 | 0.94 | 1 0 0 0 | 1 1 0 |
| 35 | 0.91 | 1 0 0 0 | 1 1 0 |
| 36 | 0.89 | 1 0 0 1 | 1 1 0 |
| 37 | 0.86 | 1 0 0 1 | 1 1 0 |
| 38 | 0.84 | 1 0 0 1 | 1 0 1 |
| 39 | 0.82 | 1 0 0 1 | 1 0 1 |
| 40 | 0.80 | 1 0 1 0 | 1 0 1 |
| 41 | 0.78 | 1 0 1 0 | 1 0 1 |
| 42 | 0.76 | 1 0 1 0 | 1 0 1 |
| 43 | 0.74 | 1 0 1 0 | 1 0 1 |
| 44 | 0.73 | 1 0 1 1 | 1 0 1 |
| 45 | 0.71 | 1 0 1 1 | 1 0 1 |
| 46 | 0.70 | 1 0 1 1 | 1 0 0 |
| 47 | 0.68 | 1 0 1 1 | 1 0 0 |
| 48 | 0.67 | 1 1 0 0 | 1 0 0 |
| 49 | 0.65 | 1 1 0 0 | 1 0 0 |
| 50 | 0.64 | 1 1 0 0 | 1 0 0 |
| 51 | 0.63 | 1 1 0 0 | 1 0 0 |
| 52 | 0.62 | 1 1 0 1 | 1 0 0 |
| 53 | 0.60 | 1 1 0 1 | 1 0 0 |
| 54 | 0.59 | 1 1 0 1 | 1 0 0 |
| 55 | 0.58 | 1 1 0 1 | 1 0 0 |
| 56 | 0.57 | 1 1 1 0 | 1 0 0 |
| 57 | 0.56 | 1 1 1 0 | 0 1 1 |
| 58 | 0.55 | 1 1 1 0 | 0 1 1 |
| 59 | 0.54 | 1 1 1 0 | 0 1 1 |
| 60 | 0.53 | 1 1 1 1 | 0 1 1 |
| 61 | 0.52 | 1 1 1 1 | 0 1 1 |
| 62 | 0.52 | 1 1 1 1 | 0 1 1 |
| 63 | 0.51 | 1 1 1 1 | 0 1 1 |

As described later, when the gray scale level of the display means 1 is controlled using the table 6, the maximum power consumption of a brighter screen (image) can be suppressed by reducing the holding time while the image quality of a darker screen (image) can be improved by increasing the holding time to display high contrast and sharp images.

The timing signal generator 7 generates a synchronizing signal of a source signal line driver circuit and a writing gate signal line driver circuit of the display means that are described later and the data controller 4 as well as pulse signals supplied to the display means such as a shift register scan start signal SSP, a clock signal SCK, a latch signal LAT, a write start signal G1SP, and an erase start signal G2SP of an erasing gate signal line driver circuit. A circuit example of the timing signal generator 7 will be described later. The display means has pixels constituted by EL elements or liquid crystals and displays images by taking a digital video signal or an analog video signal.

Figure 8:
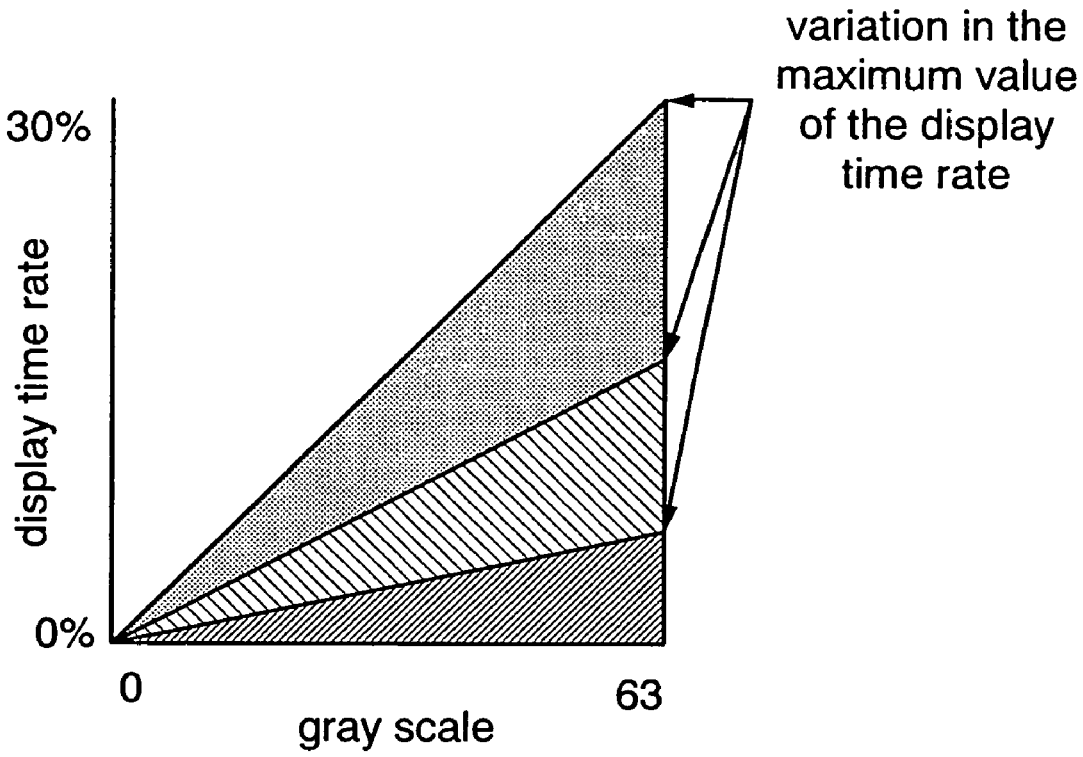
FIG. 8 shows a relation between gray scale level and display time rate of the invention.
Figure 9:
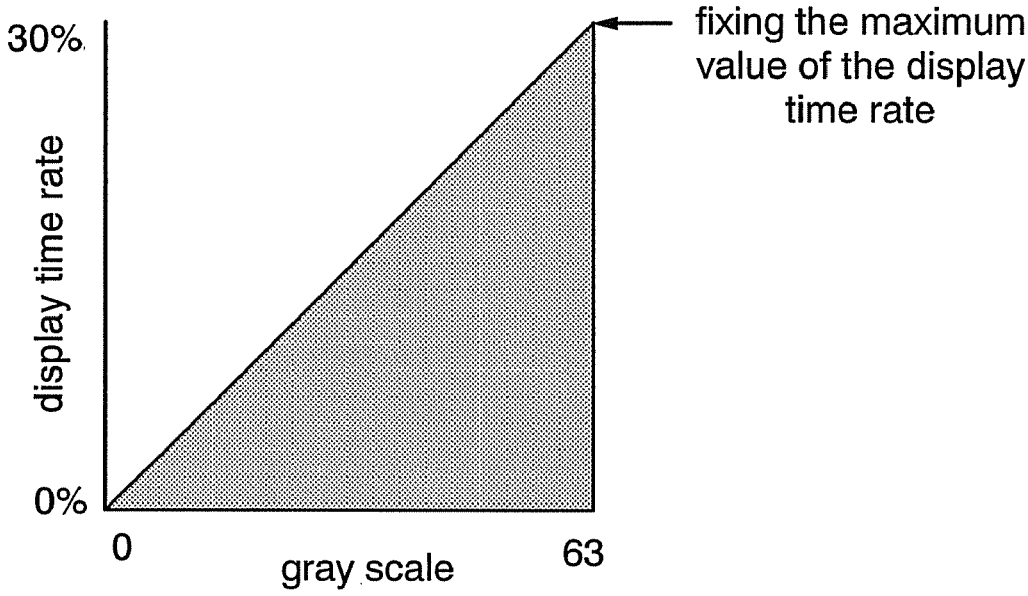
FIG. 9 shows a relation between gray scale level and display time rate of a conventional display device.

First, the principle of the gray scale control circuit 2 of the display means 1 having the aforementioned configuration is described. According to the principle, display time/(display time+non-display time)=display time rate is satisfied in one frame period, and the relation between gray scale level and display time rate is variable to reduce the display time rate at the maximum gray scale level as shown in FIG. 8.

Figure 5:
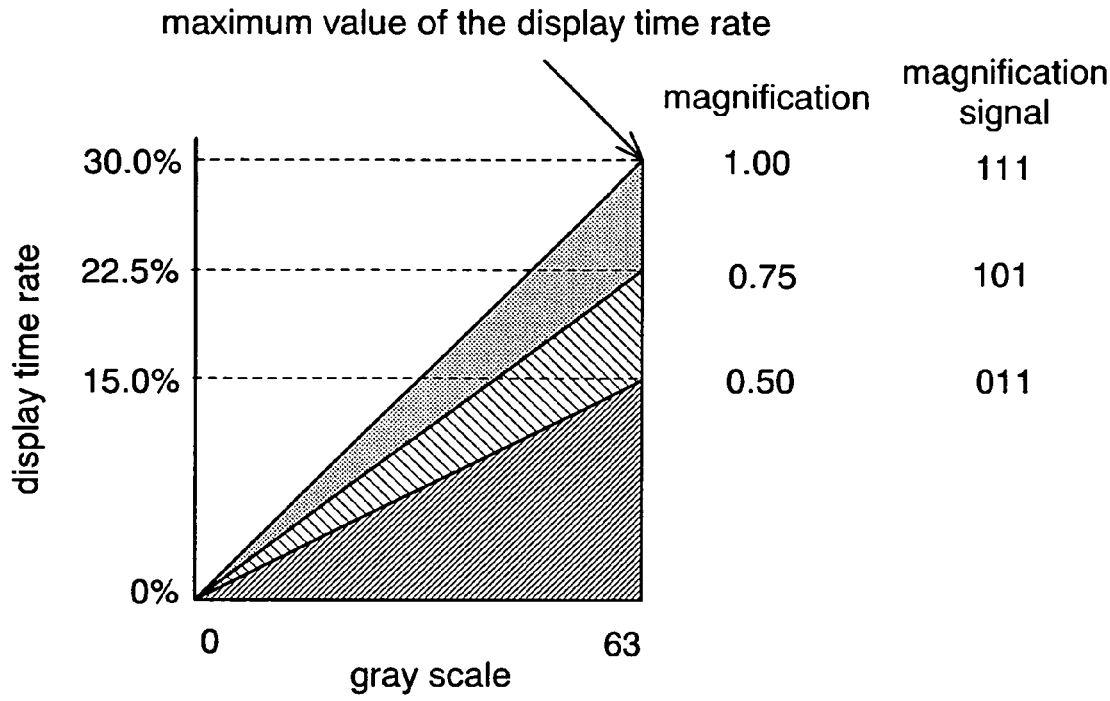
FIG. 5 shows a display time rate table of the invention.

The role of the table 6 that achieves gray scale control of the display means according to the aforementioned principle of the invention is described with reference to FIG. 5. In the table 6, the relation between gray scale level and display time rate is determined by the magnification obtained by an average gray scale signal shown in Table 1. It is assumed herein that the display time rate is display time/(display time+non-display time) in one frame period as set forth above. As shown in FIG. 5, the magnification (1.00 time) is based on the maximum value (30.0% in FIG. 5) of the display time rate. This magnification signal is represented by an arbitrary number of bits (three bits in Table 1).

For example, 1 time of magnification is represented by (111), 0.75 is represented by (101), and 0.5 is represented by (011). Fractions obtained by converting the magnification into a magnification signal are handled arbitrarily. For example, 0.5 times of magnification of (111), which is about intermediate between (100) and (011), is rounded down in Table 1. Eventually, only the relation between average gray scale level (input of the table 6) and magnification (output of the table 6) is set as the display time rate table. The relation between gray scale level and display time rate is adjusted by the relation between gray scale level and this magnification using an erase start signal generating circuit (FIGS. 3 and 4) described later.

Description is made on technical significance of controlling the gray scale level of the display means using the data shown in Table 1. When an image with a high average gray scale level is displayed, the brightness of the entire screen increases, leading to increase in power consumption. The maximum power consumption occurs when an average gray scale level is the same as the maximum gray scale level (63 gray scale level among 0 to 63 gray scale levels in FIG. 7). Specifications of a product such as power consumption and heating value are required to be determined based on the maximum power consumption, and it is necessary to provide product assurance under this condition. Actually, however, grey scale images such as pictures are displayed in many cases, thus an average gray scale level does not increase so much.

Figure 6:
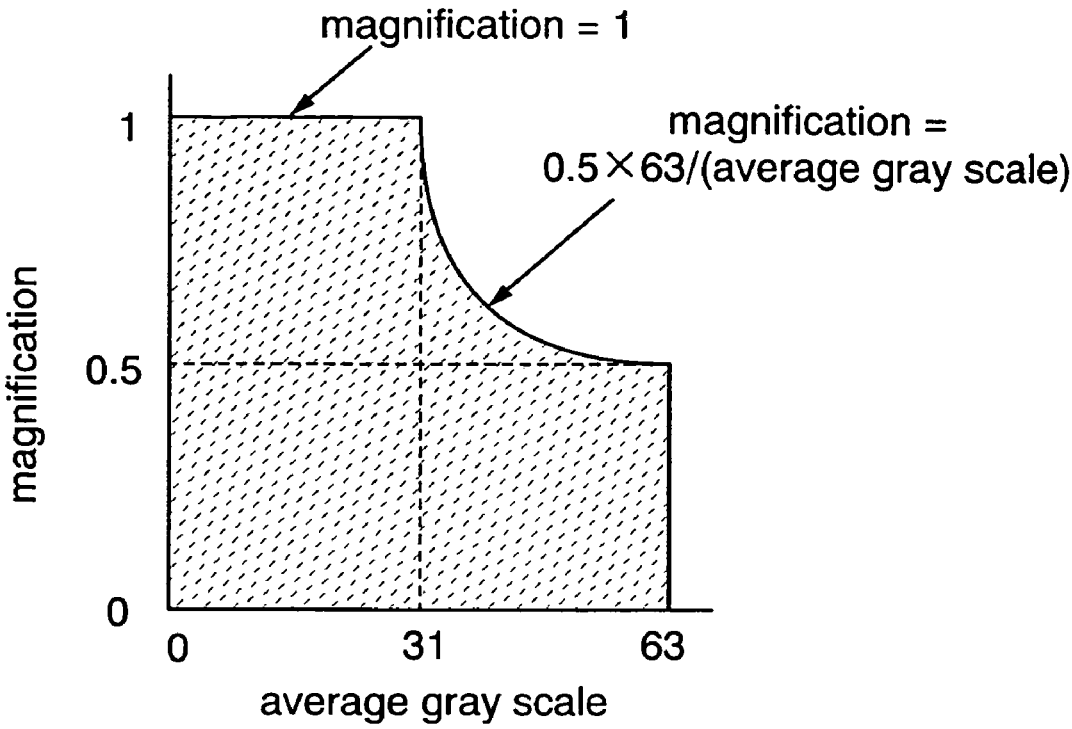
FIG. 6 shows a display time rate table of the invention.

The maximum power consumption can be suppressed by using a table for reducing a display time rate when an average gray scale level exceeds a certain value, which allows the power consumption of the display means to be reduced. For example, as shown in FIG. 6, a display time rate is fixed (1 time of magnification) with an average gray scale level of 0 to 31, and a display time rate is reduced with an average gray scale level of more than 31 to 63 (1 to 0.5 times of magnification, magnification=(0.5×63)/average gray scale level) in accordance with the average gray scale level. Thus, the display time rate decreases and the brightness of the display means decreases, thereby power consumption can be suppressed to a certain value (power consumption 0.5 times that of the conventional display device).

Figure 7:
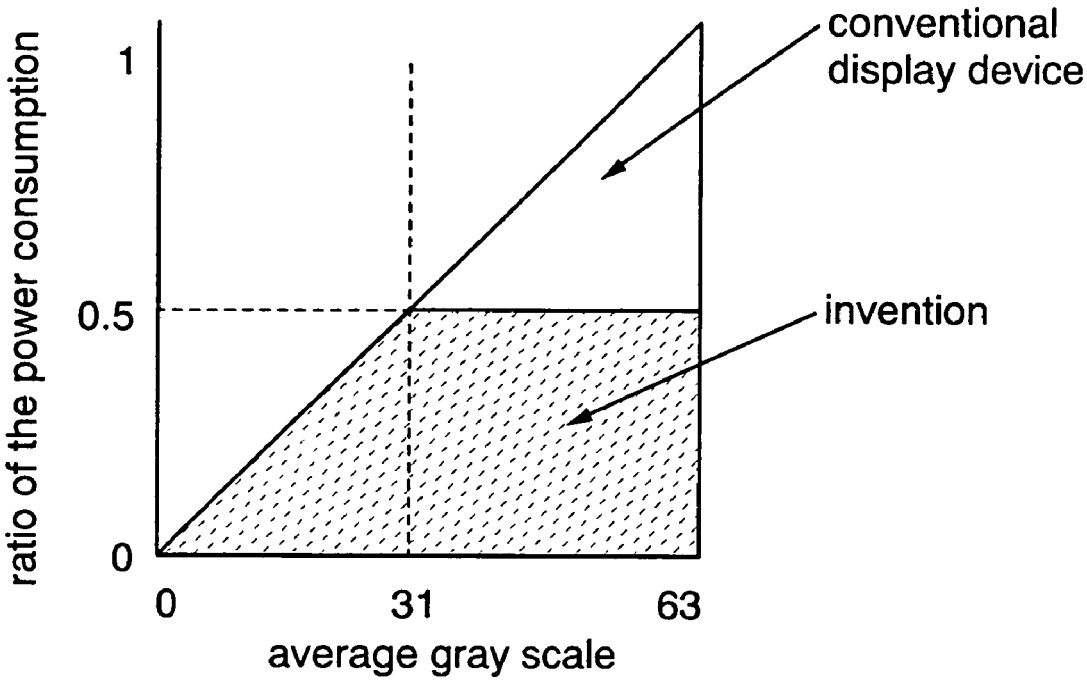
FIG. 7 shows a relation between average gray scale level and power consumption.

Power consumption in the case of the maximum value of the display time rate being fixed is compared with that in the case of the maximum value of the display time rate being variable. FIG. 7 shows the relation between average gray scale level and power consumption of the display means in the case of using the relation between average gray scale level and magnification shown in FIG. 6. When the relation between maximum gray scale level and display time rate (maximum value of the display time rate) is fixed in the conventional way, power consumption increases in proportion to the average gray scale level. It is necessary to change the design to decrease the brightness of images if the maximum power consumption is too large. In such a case, however, the brightness of an image with a low average gray scale level and partially having bright light emission (e.g., image of fireworks) also decreases. Meanwhile, according to the invention, power consumption can be suppressed to a certain value even when an average gray scale level increases. Further, an image with a low average gray scale level can be displayed without decreasing the brightness while suppressing the maximum power consumption. Although the maximum power consumption is reduced to half (0.5 times of magnification) that in the conventional case in FIG. 7, it can be further suppressed by changing the data of the aforementioned table. In order to make the maximum power consumption $\alpha$ times ($\alpha$=1) that in the conventional case, a display time rate is fixed (1 time of magnification) with an average gray scale level of 0 to ($\alpha$×maximum gray scale level) while a display time rate is set to satisfy magnification=($\alpha$×maximum gray scale level)/average gray scale level with an average gray scale level of more than ($\alpha$×maximum gray scale level) to the maximum gray scale level. The relation between average gray scale level and magnification is not limited to the one shown in FIG. 6. For example, a display time rate may be fixed (1 time of magnification) with an average gray scale level of 0 to $\alpha$×maximum gray scale level, while a display time rate may be set to satisfy magnification=1+$\alpha$−(average gray scale level/maximum gray scale level) with an average gray scale level of more than ($\alpha$×maximum gray scale level) to the maximum gray scale level.

A CRT display that is a kind of display means has characteristics of low peak luminance with a high average gray scale level and high peak luminance with a low average gray scale level, which achieve sharp images. In a conventional liquid crystal display panel, the same characteristics as the CRT display are obtained by adjusting the luminance of a backlight (see Japanese Patent Laid-Open No. 2001-147667, for example). However, it is difficult to control the backlight accurately at high speed.

According to the invention, the relation between average gray scale level and peak luminance can be determined only by setting the aforementioned table. Further, the relation can be set for each frame, therefore, the gray scale level can be controlled at high speed.

The human visual system easily recognizes bright images in a bright environment (light adaptation) whereas recognizes dark images in a dark environment (dark adaptation). The human eye can only see a narrow luminance range at a time, though it can accommodate an extremely wide luminance range. Since the relation between maximum gray scale level and luminance is fixed in the conventional display device, a white spot appears on the highlight portion when a bright image is displayed while a black spot appears when a dark image is displayed. Meanwhile, by using the aforementioned table, the relation between gray scale level and luminance can be changed dynamically in accordance with an average gray scale level, thus wide dynamic range images that are closer to the human visual system can be displayed. For example, when an expressive image is required to be displayed in the highlight portion, the magnification is set close to 1, and when an expressive image is required to be displayed in the dark portion, the magnification is reduced.

In general, a display device has a luminance control function. Luminance control can be performed by changing a power supply voltage. If an EL element is used for a display means, however, it is difficult to adjust light emission linearly since the EL element has a non-linear relation between voltage and luminance. When using the aforementioned table, luminance control can be performed by changing the relation between average gray scale level and display time rate. Accordingly, high speed, accurate, and simple luminance control is allowed by using digital processing. Conventionally, the number of display gray scale levels decreases when luminance is controlled by reducing gray scale levels as shown in FIG. 14B. Meanwhile, according to the invention, when the relation between average gray scale level and display time rate varies based on the aforementioned table, the luminance of images can be reduced while maintaining the number of display gray scale levels as shown in experimental data in FIG. 14A.

Figure 2:
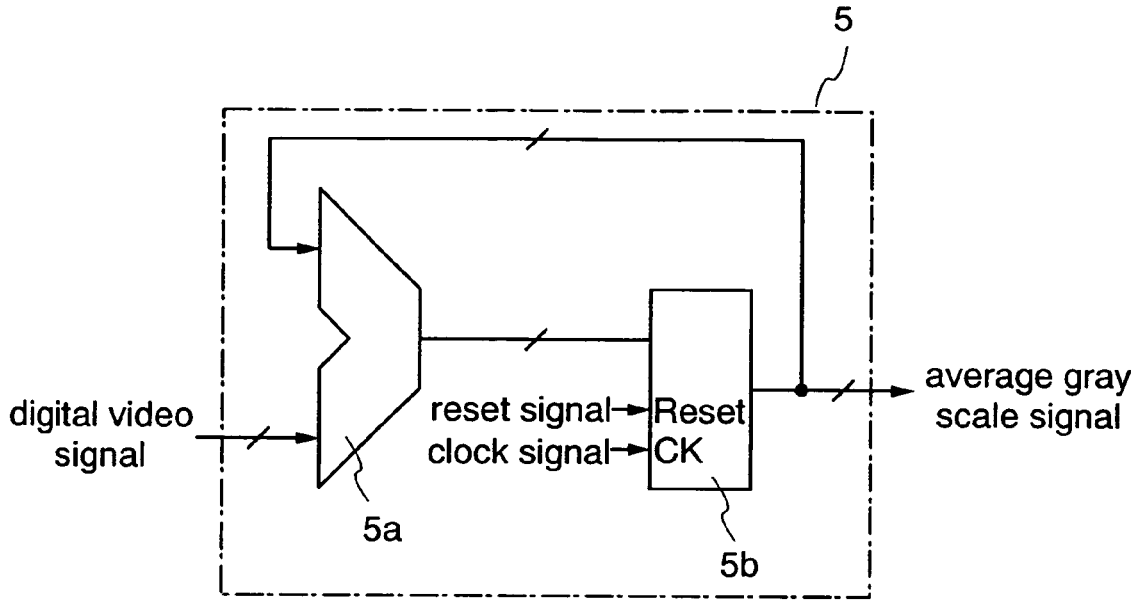
FIG. 2 shows an example of an average gray scale calculating portion of a gray scale control circuit of the invention.

A circuit example of the one frame average gray scale calculating portion 5 shown in FIG. 1 is described with reference to FIG. 2. An average gray scale level can be obtained from accumulated gray scale levels of digital video signals of all pixels in one frame. As shown in FIG. 2, the one frame average gray scale calculating portion 5 includes an adder 5*a* and an accumulator 5*b*. A digital video signal and the output of the accumulator 5*b* are inputted to the adder 5*a*, and the sum of these inputs is inputted to the accumulator 5*b*. The accumulator Sb records the output of the adder 5*a* at a clock timing synchronized with a digital video signal, and the output is initialized by a reset signal synchronized with one frame. The number of bits recorded by the accumulator 5*b* is determined depending on the number of bits of a digital video signal and the number of pixels of the display means. For example, when a digital video signal has six bits and the number of pixels of the display means is $320\times240\times3=230400<2^{18}$, an accumulator capable of recording 6+18=24 bits is employed.

When digital video signals of all the pixels of one frame are inputted to the one frame average gray scale calculating portion 5, accumulated gray scale levels of all the pixels of one frame are recorded in the accumulator 5*b*. Since the accumulated gray scale levels are proportional to the average gray scale level, the most significant few bits of the accumulator 5*b* can be considered as average gray scale signals. In the aforementioned table, the most significant four bits are inputted and used as average gray scale signals. The aforementioned circuit as shown in FIG. 2 may be incorporated or an average gray scale signal obtained by an external device may be utilized.

Figure 3:
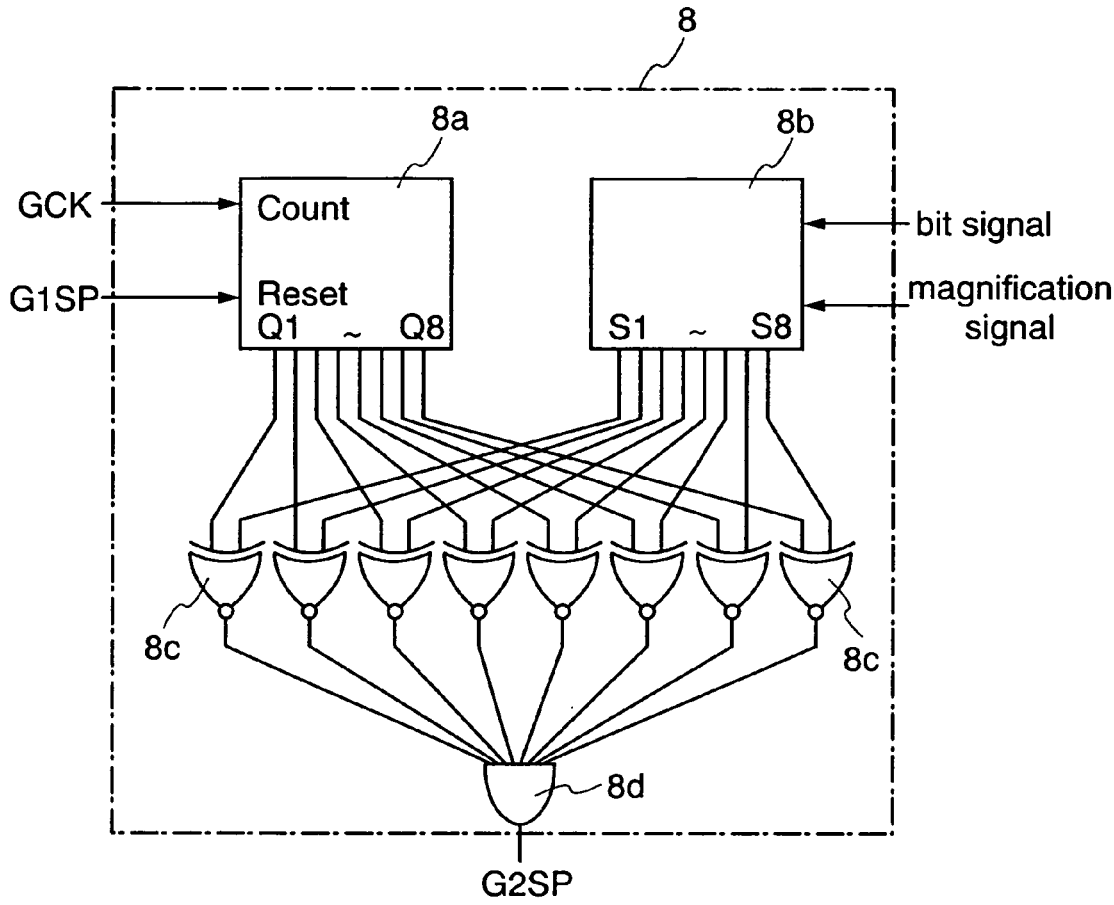
FIG. 3 shows an example of an erase start signal generating circuit used in the invention.
Figure 12:
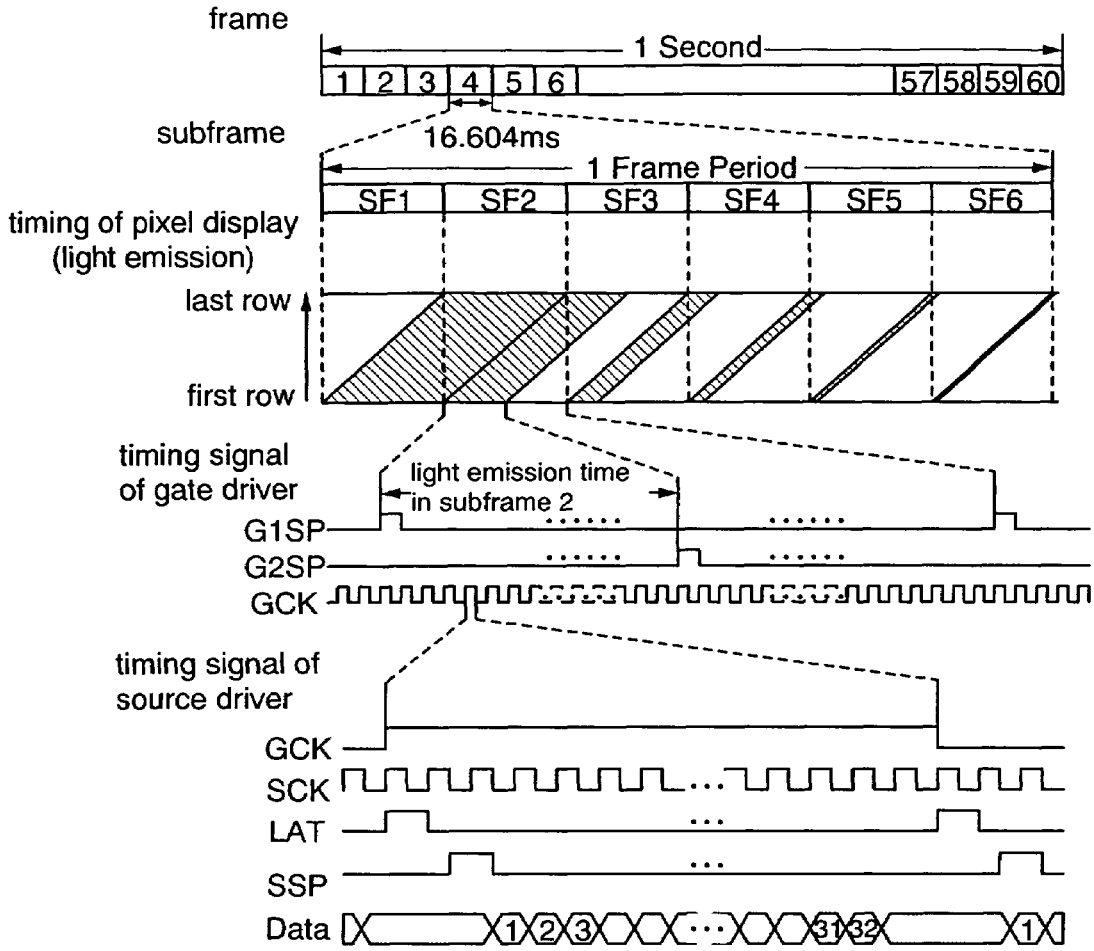
FIG. 12 is a timing chart of a digital signal in the operation of a display device of the invention.

When the gray scale control circuit 2 for controlling the gray scale level of the display means 1 shown in FIG. 1 is described with reference to a timing chart shown in FIG. 12, the magnification signal of the aforementioned table is used for generating a timing signal (erase start signal G2SP) for erasing a digital video signal written to a pixel of the display means 1. Therefore, the generation of the timing signal is described hereinafter. As shown in FIG. 3, an erase start signal generating circuit 8 has a counter 8*a*, an accumulator 8*b*, EXNOR circuits 8*c*, and an AND circuit 8*d*. The counter 8*a* counts a writing clock GCK using a scan start signal G1SP for writing to a pixel as a reset signal. The output of the counter 8*a* is proportional to the time elapsed since the G1SP was inputted.

A bit signal and a magnification signal corresponding to the average gray scale level obtained by the aforementioned table are inputted to the accumulator 8*b*. For example, if one frame is divided into six subframes SF1 to SF6 to be equal to the number of gray scale bits 6 as shown in the timing chart of FIG. 12, this bit signal corresponds to each bit weight (light emission time of a pixel) such as the weight 32 ($2^5$) of the first subframe SF1, the weight 16 ($2^4$) of the second subframe SF2, the weight 8 ($2^3$) of the third subframe SF3, the weight 4 ($2^2$) of the fourth subframe SF4, the weight 2 ($2^1$) of the fifth subframe SF5, and the weight 1 ($2^0$) of the sixth subframe SF6. The output of the accumulator 8*b* is the product of the weight of each of the subframes SF1 to SF6 and the magnification signal.

A matching circuit configured by the EXNOR circuits 8*c* and the AND circuit 8*d* outputs the erase start signal G2SP when outputs Q1 to Q8 of the counter 8*a* coincide with outputs S1 to S8 of the accumulator 8*b*. The display time rate of a pixel is thus controlled by controlling the timing at which the erase start signal G2SP is generated by the product of the weight of each subframe and the magnification signal.

The technical significance of the aforementioned table is described heretofore. The actual gray scale control is described below with reference to the block diagram of the gray scale control circuit 2 shown in FIG. 1 and the timing chart shown in FIG. 12. As shown in the timing chart of FIG. 12, each frame of 60-frame video signals for one second, for example the fourth frame in the drawing is divided into six subframes SF1 to SF6 as described in the erase start signal generating circuit. When the ratio of the intervals between the write start signal G1SP and the erase start signal G2SP is power of 2 in each of the subframes SF1 to SF6 (only the subframe SF2 is shown as an example in FIG. 12), the number of gray scale bits is six as the number of subframes, thereby the number of display gray scale levels is $2^6=64$. With the increase in the number of subframes, the number of display gray scale levels increases. If the number of subframes is n, the number of display gray scale levels is $2^n$. The number of display gray scale levels of the aforementioned table can be changed by increasing the number of the subframes.

As for the timing of pixel display, the ordinate represents a pixel array row, and the shaded portion represents a display time in each of the subframes SF1 to SF6. As is evident from this timing chart, a display time differs in each subframe. As described in Embodiments, the display means shown in FIG. 1 has a gate signal line driver circuit for selecting a gate signal line and a source signal line driver circuit for supplying a video signal to a pixel connected to the selected gate signal line. A timing signal of the gate signal line driver circuit is described with reference to the second subframe SF2 shown as an example in the timing chart. The pixel array is sequentially scanned from the first row to the last row using the G1SP as a write scan start signal in synchronization with the clock GCK. Then, the pixel array is sequentially scanned from the first row to the last row using the G2SP as an erase start signal in synchronization with the clock GCK, thereby non-display state is obtained.

A light emission time in each subframe is thus determined by the time from the G1SP to the G2SP. The invention is characterized in that the display time rate is controlled by varying the timing of the G2SP in each subframe based on the output of the aforementioned table. As set forth above in the generating circuit of the erase start signal G2SP (FIG. 3), the erase start signal G2SP is generated by the product of the weight of each of the subframes SF1 to SF6 and the magnification of the table. Accordingly, by controlling the generation timing of the erase start signal G2SP based on the table, the maximum value of the display time rate can be reduced when an average gray scale level exceeds a certain value (FIGS. 6 and 8). Thus, the maximum power consumption can be suppressed to a certain value as shown in FIG. 7, leading to reduction in the power consumption of the display means.

Described hereinafter are embodiments of gray scale control of a display device using an EL display panel as the display means.

Embodiment 1

Figure 10:
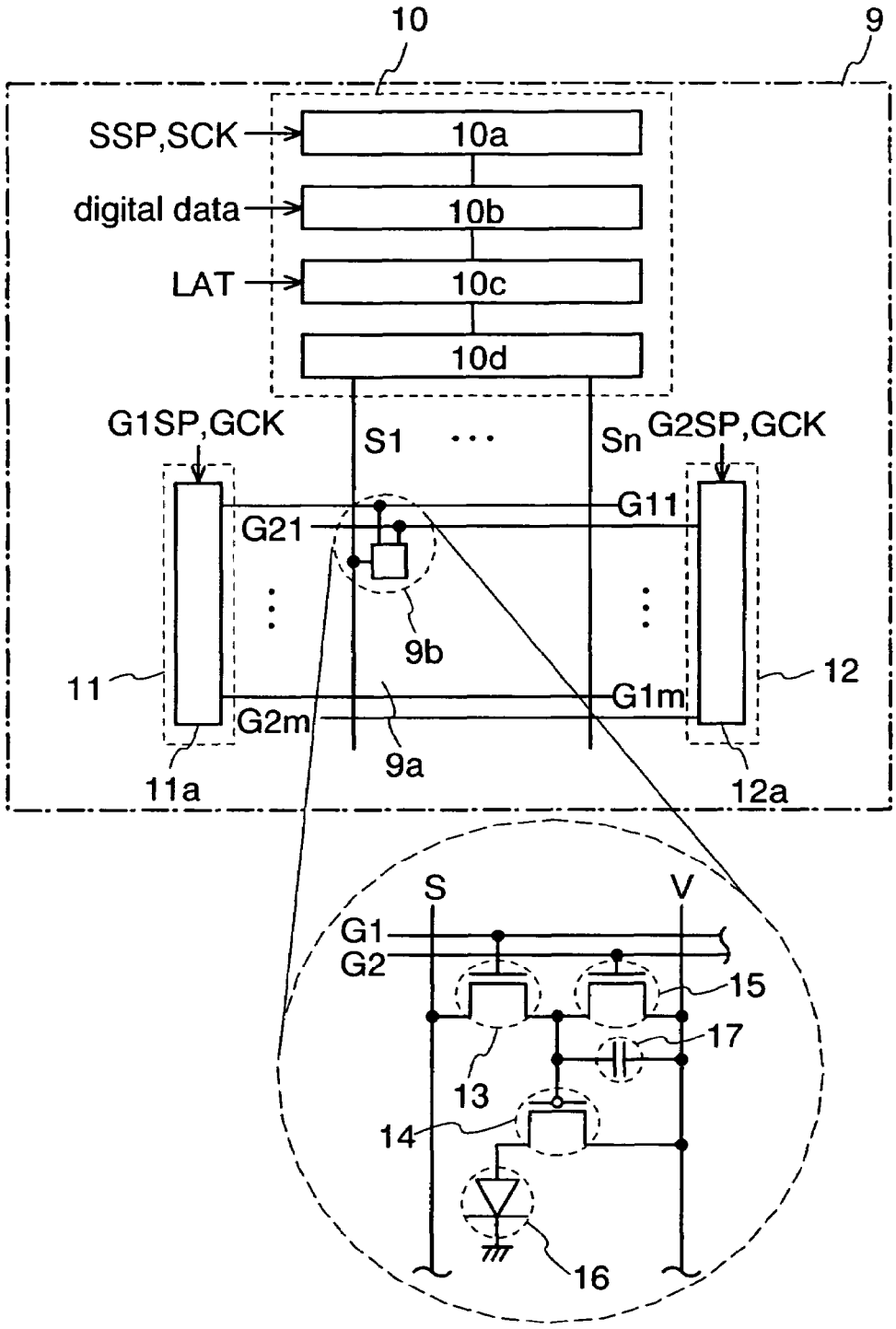
FIG. 10 is a circuit diagram showing a circuit configuration of a display device of the invention.

As shown in FIG. 10, a digital signal input active matrix EL display panel 9 using an EL element in a pixel has a pixel portion 9*a* including a pixel 9*b* arranged in matrix, and a source signal line driver circuit 10, a writing gate signal line driver circuit 11, and an erasing gate signal line driver circuit 12 that are disposed at the periphery of the pixel portion 9*a*. The source signal line driver circuit 10 has a shift register 10*a*, a latch 10*b*, a latch 10*c*, and a level shifter buffer 10*d*. The gate signal line driver circuits 11 and 12 have shift registers 11*a* and 12*a* respectively.

The pixel portion 9*a* further has source signal lines (S1 to Sn) connected to the level shifter buffer 10*d* of the source signal line driver circuit 10, writing gate signal lines (G11 to G1*m*) connected to the shift register 11*a* of the writing gate signal line driver circuit 11, and erasing gate signal lines (G21 to G2*m*) connected to the shift register 12*a* of the erasing gate signal line driver circuit 12. Each of the signal lines is connected to the corresponding pixel 9*b* arranged in matrix that includes an EL element.

The pixel 9*b* includes a writing switching TFT 13, an EL driving TFT 14 connected to an EL element 16, an erasing TFT 15, and a capacitor 17. The TFT means a thin film transistor herein, though other transistors may be used as long as they have the same function. A gate electrode of the writing switching TFT 13 is connected to a writing gate signal line G1, one of a source region and a drain region thereof is connected to a source signal line S, and the other is connected to a gate electrode of the EL driving TFT 14. Further, the writing switching TFT 13 is connected to the capacitor 17 in each pixel and one of a source region and a drain region of the erasing TFT 15. The capacitor 17 is provided in order to hold a gate voltage of the EL driving TFT 14 when the writing switching TFT 13 is off (non-selected state).

One of a source region and a drain region of the EL driving TFT 14 is connected to a power supply line V and the other is connected to an anode of the EL element 16. The power supply line V is connected to the capacitor 17. The source region or the drain region of the erasing TFT 15, which is not connected to the writing switching TFT 13, is connected to the power supply line V. A gate electrode of the erasing TFT 15 is connected to an erasing gate signal line G2.

Gray scale control of the EL display panel using the gray scale control circuit 2 is described with reference to FIG. 10 and the timing chart of FIG. 12. When the shift register 10*a* of the source signal line driver circuit 10 starts scanning with a scan start signal SSP synchronized with a synchronizing signal SCK, digital video signals of one row held in a frame memory of the data controller 4 (FIG. 1) are inputted to the latch 10*b* corresponding to the source signal lines S1 to Sn. When a latch signal LAT is inputted and latched to the latch 10*c*, the digital data inputted to the latch 10*b* are amplified in the level shifter buffer 10*d* and sequentially outputted to the source signal lines S1 to Sn.

On the other hand, the shift register 11*a* of the writing gate signal line driver circuit 11 starts scanning with the scan start signal G1SP synchronized with the synchronizing signal SCK to select the writing gate signal lines G11 to G1*m* sequentially. When the writing gate signal lines G11 to G1*m* are sequentially selected, digital data of one row is inputted to a pixel connected to the writing gate signal line from the source signal lines S1 to Sn during a selection period of each writing gate signal line.

Described hereinafter is an example of writing and erasing a 6-bit digital video signal to the EL display panel 9. When the scan start signal G1SP is inputted to the writing gate signal line driver circuit 11, the writing switching TFTs 13 in all the pixels connected to the writing gate signal line G11 of the first row are turned on. At the same time, the first bit digital data "0" or "1" of a digital video signal is inputted to the source signal lines S1 to Sn from the latch 10*c*. This digital data is inputted to the gate electrode of the EL driving TFT 14 through the writing switching TFT 13. If the digital data "1" is inputted, the EL driving TFT 14 is turned on and the EL element 16 emits light. Meanwhile, if the digital data "0" is inputted, the EL driving TFT 14 is turned off and the EL element 16 emits no light. As described above, when the digital data is inputted to the pixels of the first row, the EL element emits light or no light and the pixels of the first row display images.

Next, when the writing gate signal line G12 of the second row is selected, the writing switching TFTs 13 in all the pixels connected to the writing gate signal line G12 are turned on, thereby the second bit digital data is inputted to the pixels of the second row from the source signal lines S1 to Sn. Then, all the writing gate signal lines (G11 to G1*m*) are sequentially selected, and the second bit digital data is inputted to the pixels of all the rows in the subframe SF2.

When the time corresponding to the magnification signal elapses from the input of the signal G1SP, the erase start signal G2SP synchronized with the clock GCK is inputted to the shift register 12*a* of the erasing signal line driver circuit 12. The erase start signal G2SP is inputted to the erasing gate signal line G21 from the shift register 12*a*. Then, the erasing TFTs 15 in all the pixels connected to the erasing gate signal line G21 are turned on and the potentials at the source region and the gate electrode of the EL driving TFT 14 become equal to each other, thereby the EL driving TFT 14 is turned off. Accordingly, a power supply potential of the power supply line V is not supplied to the EL elements 16, all the EL elements 16 in the pixels of the first row emit no light, and thus the pixels of the first row display no image. Next, when the erasing gate signal line G22 of the second row is selected, the erasing TFTs 15 in all the pixels connected to the erasing gate signal line G22 are turned on and the potentials at the source region and the gate electrode of the EL driving TFT 14 become equal to each other, thereby the EL driving TFT 14 is turned off. Then, all the erasing gate signal lines (G21 to G2*m*) are sequentially selected, and the EL elements 16 of all the rows are sequentially brought into a non-emission state in the subframe SF2.

The display (light emission) time rate can thus be controlled by erasing a digital video signal supplied to a pixel connected to the erasing gate signal line using the erase start signal G2SP generated at the timing based on the magnification signal of the aforementioned table as a scan start signal of an erasing gate signal line driver circuit.

In this manner, operations of displaying and erasing are repeated until the first to sixth digital data is inputted to the pixels. Light emission time is controlled by the G2SP in all the subframes, and when the light emission time is completed in all the subframes, an image of one frame of which gray scale level is controlled by the output of the table is displayed. When the light emission time of each subframe is thus controlled based on the magnification signal outputted from the aforementioned table, the maximum value of the light emission time rate can be reduced, leading to reduction in the power consumption of the EL display panel 9.

Further, when the light emission time of each of the subframes SF1 to SF6 is controlled based on the magnification signal outputted from the aforementioned table, it is possible to vary the light emission time in each subframe at the timing of the erase start signal G2SP. Accordingly, different light emission times can be selected arbitrarily, and more numbers of gray scale levels than the number of subframes can be displayed. For example, if one frame is divided into n subframes, an image with $2^n$ gray scale levels can be displayed when the selected different light emission times are set to $2^0$ to $2^{n-1}$ respectively.

Embodiment 2

Figure 4:
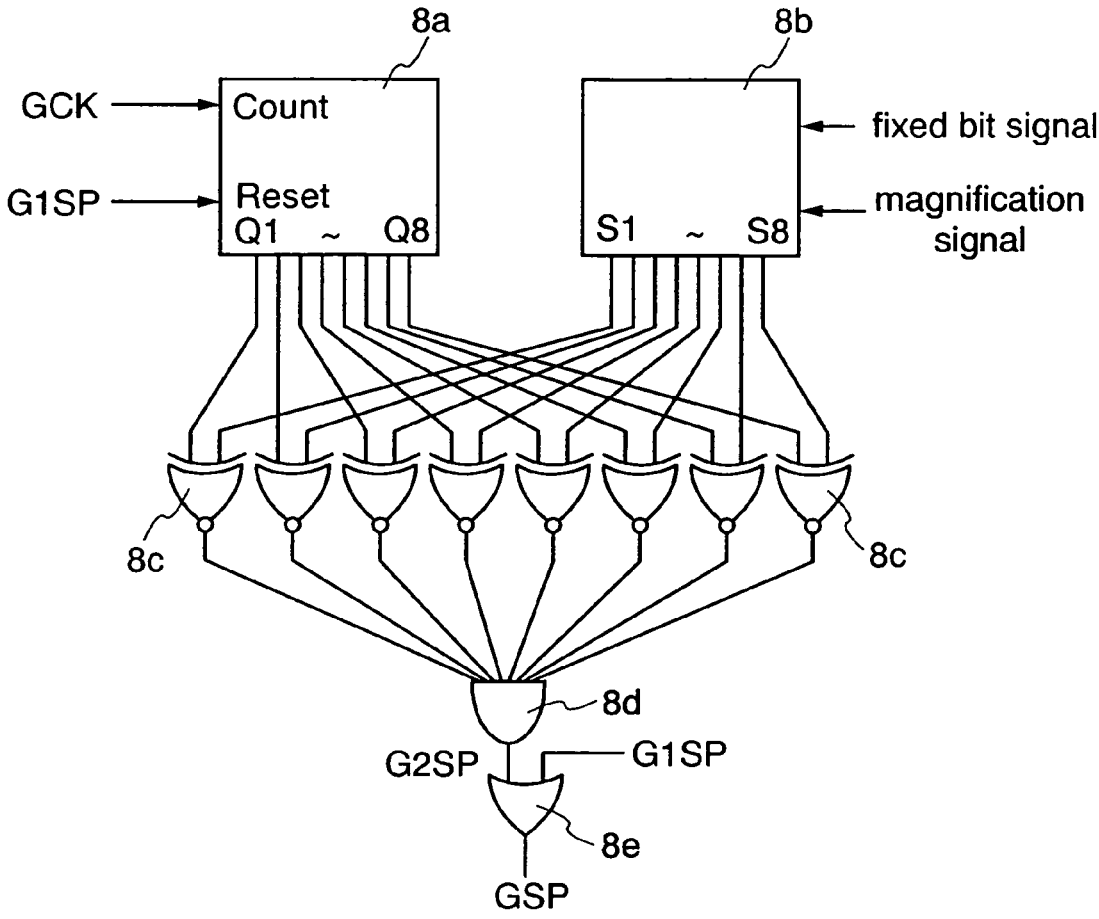
FIG. 4 shows another example of an erase start signal generating circuit used in the invention.

Described is an embodiment of gray scale control using the aforementioned table in the case where an analog signal is inputted to the display means as a video signal. When an analog signal is inputted as a video signal, a D/A converter is provided in the data controller 4 in the block diagram shown in FIG. 1, and a video signal converted into a digital signal by the A/D converter 3 is converted into an analog signal by the D/A converter. The other components in FIG. 1 can be utilized as they are. Since the magnification signal of the table shown in Table 1 is employed, an erase start signal generating circuit for generating an erase start signal GSP is described hereinafter with reference to FIG. 4. As shown in FIG. 4, the erase start signal generating circuit has the counter 8*a*, the accumulator 8*b*, the EXNOR circuits 8*c*, the AND circuit 8*d*, and an OR circuit 8*e*. The counter 8*a* counts a writing clock GCK using a scan start signal G1SP for writing to a pixel as a reset signal (timing chart of FIG. 13 described later). The output of the counter 8*a* is proportional to the time elapsed since the write scan start signal G1SP was inputted.

A magnification signal corresponding to the gray scale level of the table and a fixed bit signal are inputted to the accumulator 8*b*. Since a video signal inputted to the display device is an analog signal and the frame is not divided differently from the digital video signal, a bit signal is fixed to predetermined digital data. For example, a bit signal is fixed to "11111". The output of the accumulator 8*b* is the product of the fixed bit signal and the magnification signal.

A matching gate configured by the EXNOR circuits 8*c* and the AND circuit 8*d* outputs the erase start signal G2SP when outputs Q1 to Q8 of the counter 8*a* coincide with outputs S1 to S8 of the accumulator 8*b*. Then, the G2SP and the G1SP are inputted to the OR circuit 8*e*, and an output GSP of the OR circuit 8*e* is used as the write scan start signal G1SP and the erase start signal G2SP.

Figure 11:
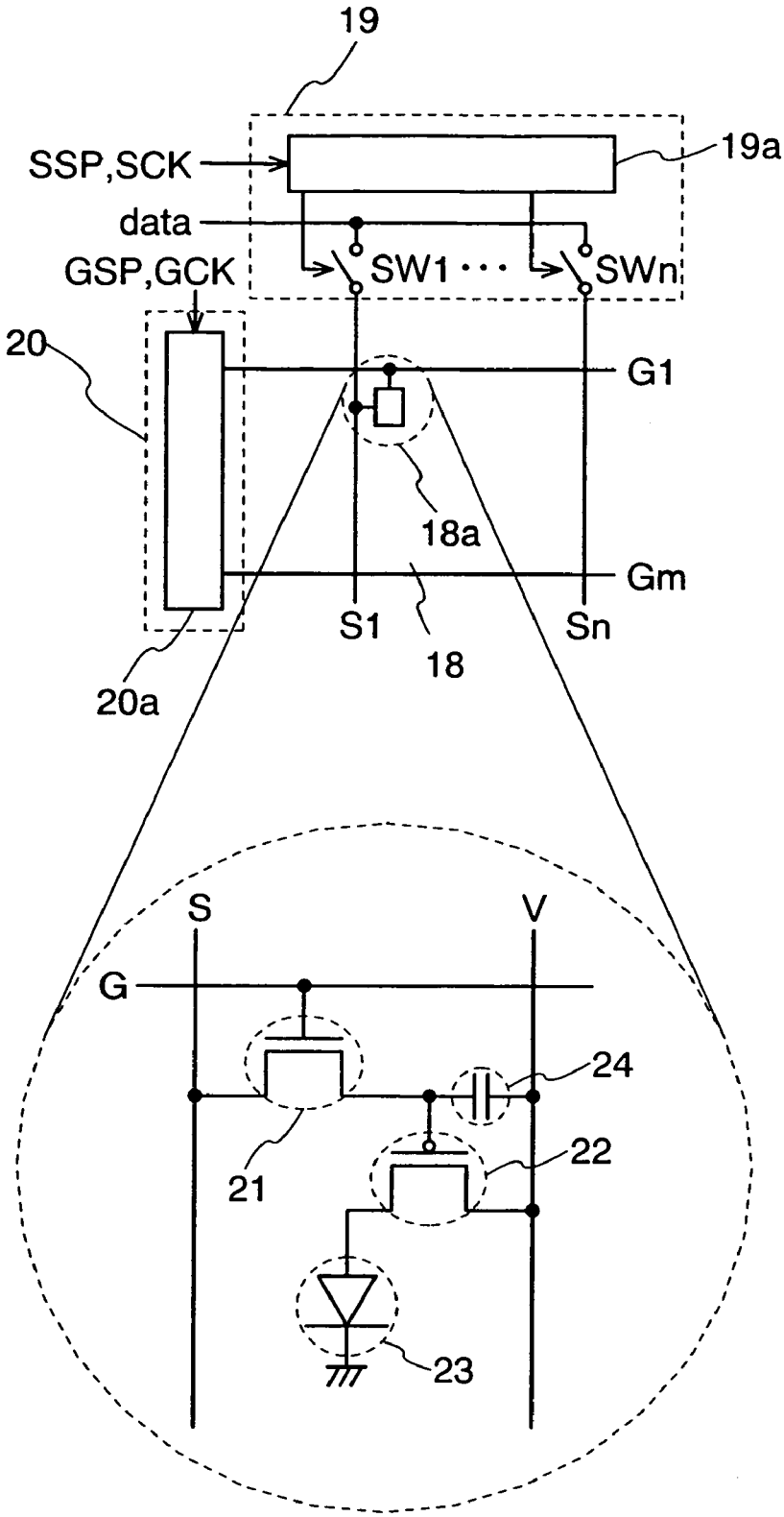
FIG. 11 is another circuit diagram showing a circuit configuration of a display device of the invention.

FIG. 11 shows an analog signal input active matrix display device using an EL display panel. As shown in FIG. 11, the analog signal input active matrix EL display panel has a pixel portion 18 including a pixel 18*a* arranged in matrix, and a source signal line driver circuit 19 and a gate signal line driver circuit 20 that are disposed at the periphery of the pixel portion 18. The source signal line driver circuit 19 has a shift register 19*a* and sampling switches SW1 to SWn for sampling an analog video signal based on the output of the shift register 19*a*. The gate signal line driver circuit 20 has a shift register 20*a*.

The pixel portion 18 further has source signal lines (S1 to Sn) connected to the sampling switches SW1 to SWn respectively, and gate signal lines (G1 to Gm) connected to the shift register 20*a* of the gate signal line driver circuit 20. Each of the signal lines is connected to the corresponding pixel 18*a* arranged in matrix.

The pixel 18*a* has a switching TFT 21, an EL driving TFT 22 connected to an EL element 23, and a capacitor 24. A gate electrode of the switching TFT 21 is connected to a gate signal line G, one of a source region and a drain region thereof is connected to a source signal line S, and the other is connected to a gate electrode of the EL driving TFT 22 and the capacitor 24. The capacitor 24 is provided in order to hold a gate voltage of the EL driving TFT 22 when the switching TFT 21 is off (non-selected state). One of a source region and a drain region of the EL driving TFT 22 is connected to a power supply line V, and the other is connected to an anode of the EL element 23. The power supply line V is connected to the capacitor 24.

Figure 13:
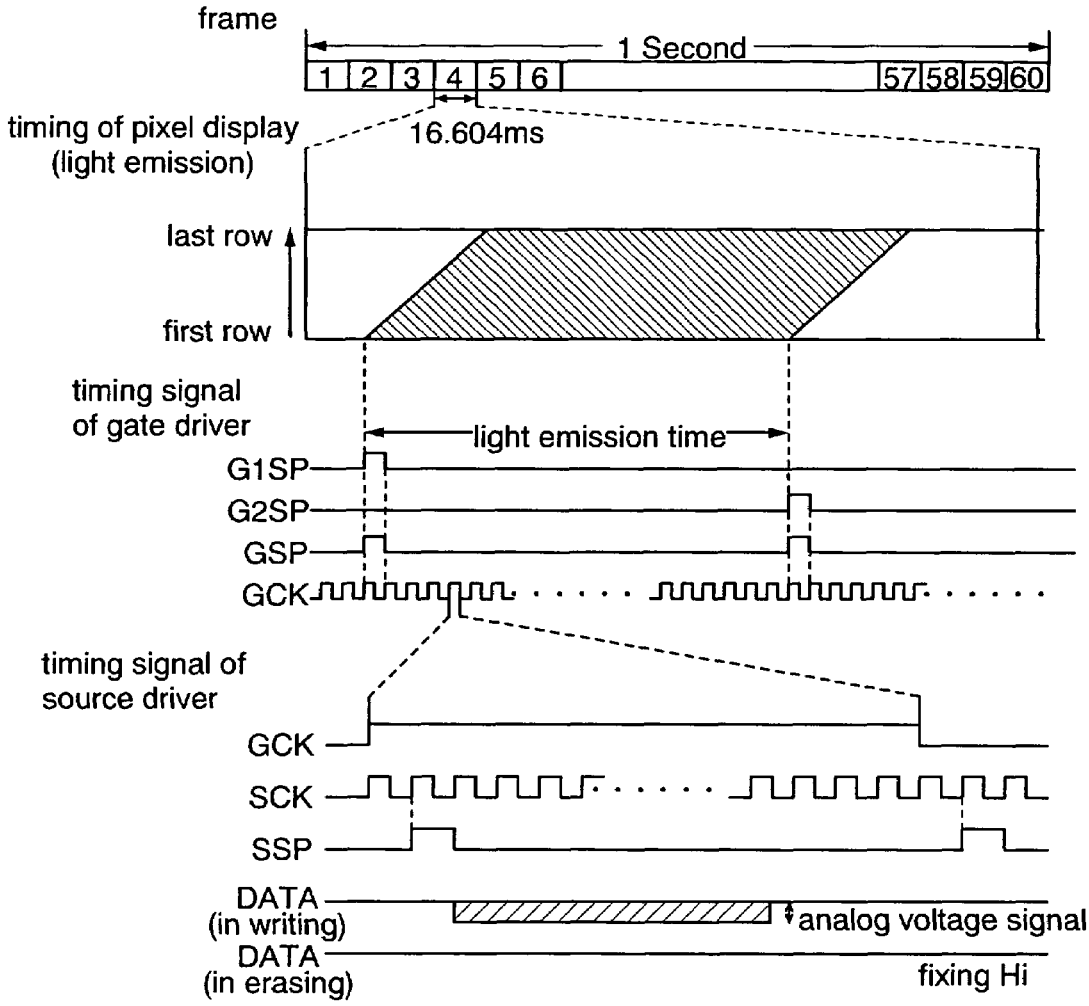
FIG. 13 is a timing chart of an analog signal in the operation of a display device of the invention.

Gray scale control of the embodiment 2 is hereinafter described with reference to FIG. 11 and a timing chart of FIG. 13. When a scan start signal SSP synchronized with a synchronizing signal SCK is inputted to the shift register 19*a* of the source signal line driver circuit 19, the sampling switches SW1 to SWn corresponding to the source signal lines S1 to Sn respectively are sequentially selected. Then, video data is inputted to the source signal lines S1 to Sn corresponding to a sampling switch selected by the shift register 19*a*.

On the other hand, the shift register 20*a* of the gate signal line driver circuit 20 selects the gate signal lines G1 to Gm sequentially when a write scan start signal GSP (G1SP) synchronized with a synchronizing signal GCK is inputted. When the write scan start signal G1SP is inputted to the gate signal line driver circuit 20, the switching TFTs 21 in all the pixels connected to the gate signal line G1 of the first row are turned on. At the same time, a video signal is inputted to the gate electrode of the EL driving TFT 22 from the source signal lines S1 to Sn. Depending on the video signal, each of the EL elements 23 of the first row emits light or no light, thereby the pixels of the first row display images. Then, all the gate signal lines (G1 to Gm) are sequentially selected, and video signal data is inputted to the pixels of all the rows.

Analog video signals of one frame are inputted to all the pixels to display images. After that, in a vertical flyback period, an erase start signal GSP (G2SP) based on the magnification signal of the aforementioned table is inputted to the gate signal line driver circuit 20. In the vertical flyback period, the potentials of the source signal lines S1 to Sn are fixed to potentials for erasing the pixels. More specifically, the shift register 19*a* is operated while analog video signals inputted before the start of the vertical flyback period are set to erasing potentials, and the erasing potentials are inputted to the source signal lines S1 to Sn. Subsequently, the gate signal lines G1 to Gm are sequentially selected using the erase start signal G2SP as an erase scan start signal, which is controlled at a timing generated based on the magnification signal. The source signal lines S1 to Sn are sequentially selected during a selection period of each gate signal line. Thus, the erasing potential is inputted to the pixel and then video signal of the pixel that is selected by the gate signal line and the source signal line is erased.

That is, when the time corresponding to the magnification signal elapses from the input of the write scan start signal G1SP, the erase start signal G2SP is inputted to the shift register 20*a* of the gate signal line driver circuit 20 and to the gate signal lines G1 to Gm from the shift register 20*a*, and all the EL driving TFTs 22 of the EL elements 23 connected to the gate signal lines G1 to Gm are turned off. Accordingly, a power supply potential of the power supply line V is not supplied to the EL elements 23, and all the EL elements 23 emit no light, thereby no image is displayed. The light emission time rate can thus be controlled by inputting the erase start signal G2SP generated at a timing based on the magnification signal of the aforementioned table to a pixel as a scan start signal and erasing an analog video signal supplied to the EL element 23 in the pixel.

Even when an analog signal is written as a video signal, the maximum value of the light emission time rate can be reduced by controlling the light emission time of one frame based on the magnification signal outputted from the aforementioned table, leading to reduction in the power consumption of the pixels of the analog signal input active matrix display means.

Embodiment 3

The aforementioned embodiment using an analog video signal as video data, which is applied to the display panel including an EL element in a pixel, can also be applied to a liquid crystal display panel including a liquid crystal in a pixel. Since a display panel including a liquid crystal in a pixel is voltage driven, a video data is inputted to the source signal line driver circuit 19 after being D/A converted into a voltage value corresponding to the display panel. According to this, even in the case of using a liquid crystal element instead of the EL element, the invention can be implemented similarly using the gray scale control circuit.

The display device of the invention where the gray scale level of the display means is controlled by the gray scale control circuit can be applied to electronic apparatuses such as a video camera, a digital camera, a goggle type display (head mounted display), a navigation system, an audio reproducing device (car audio set, audio component or the like), a notebook computer, a game machine, a portable information terminal (mobile computer, mobile phone, mobile game machine, electronic book), and an image reproducing device that reproduces an image recorded in a recording medium (specifically, digital versatile disc or the like) and has a display means for displaying the reproduced image. Specific examples of these electronic apparatuses are described hereinafter.

Embodiment 4

Figure 15:
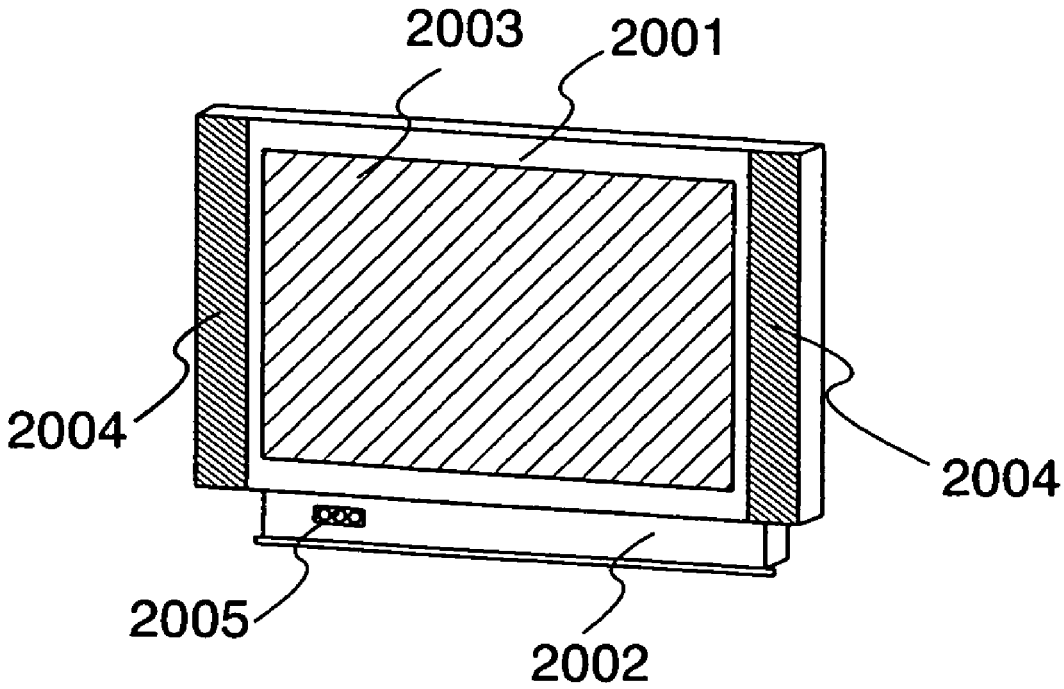
FIG. 15 shows a display device using the invention.

FIG. 15 shows a display device that includes a housing 2001, a support base 2002, a display portion 2003, speaker portions 2004, a video input terminal 2005, and the like. When the display device of the invention is used for the display portion 2003, power consumption can be reduced. According to the display device of the invention, a backlight is not needed in an EL display device and luminance control of a backlight is not needed for controlling a gray scale level in a liquid crystal display device. This display device can be used for all the devices for displaying information such as for personal computers, TV broadcasting reception, and advertisement.

Embodiment 5

Figure 16:
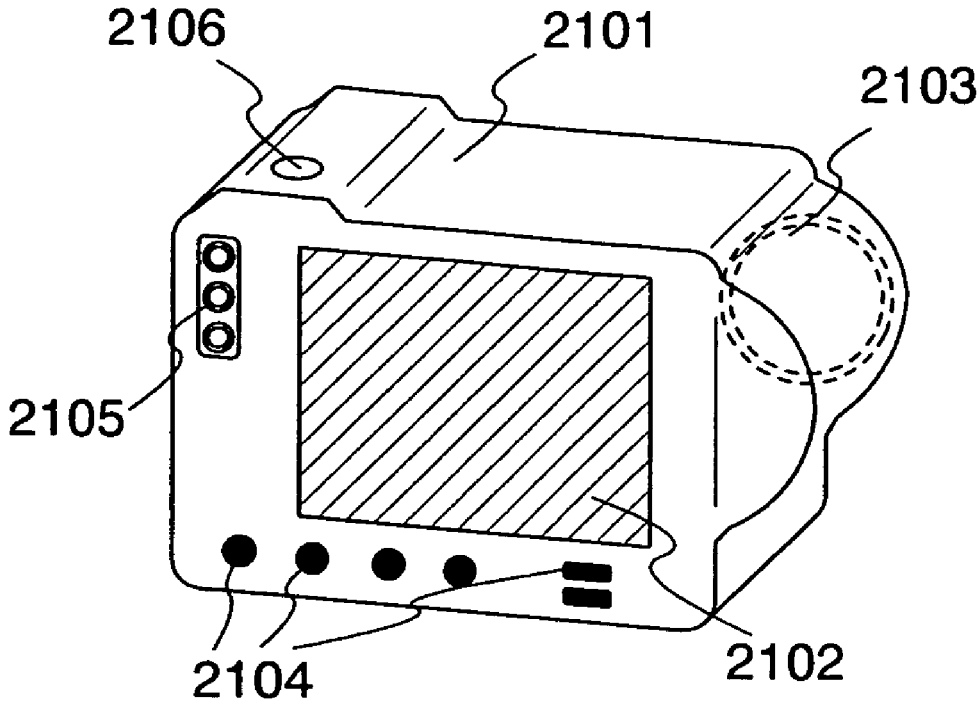
FIG. 16 shows a video camera of which display portion uses the invention.

FIG. 16 shows an example of the invention applied to a digital still camera that includes a main body 2101, a display portion 2102 using the display device of the invention, an image receiving portion 2103, operating keys 2104, an external connecting port 2105, a shutter 2106, and the like. If a rechargeable battery is used, the power consumption of the display portion 2102 can be reduced and thus the battery can last a long time.

Embodiment 6

Figure 17:
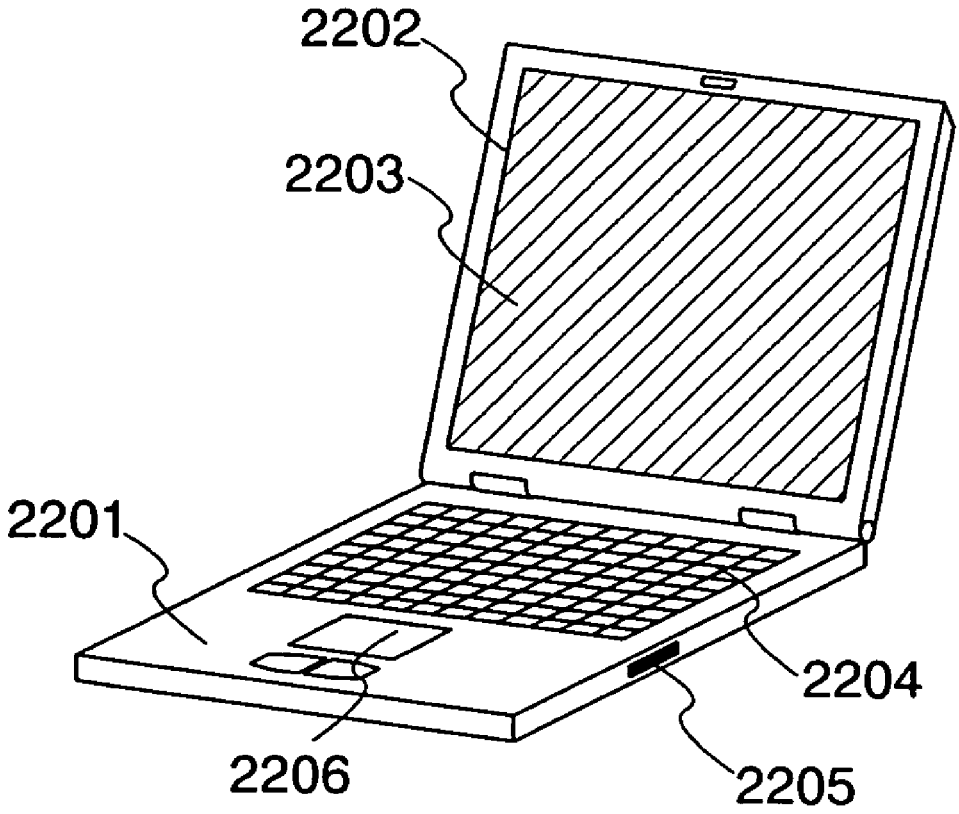
FIG. 17 shows a notebook computer of which display portion uses the invention.

FIG. 17 shows an example of the invention applied to a notebook computer that includes a main body 2201, a housing 2202, a display portion 2203 using the display device of the invention, a keyboard 2204, an external connecting port 2205, a pointing mouse 2206, and the like. If a rechargeable battery is used, the power consumption of the display portion 2203 can be reduced and thus the battery can last a long time.

Embodiment 7

Figure 18:
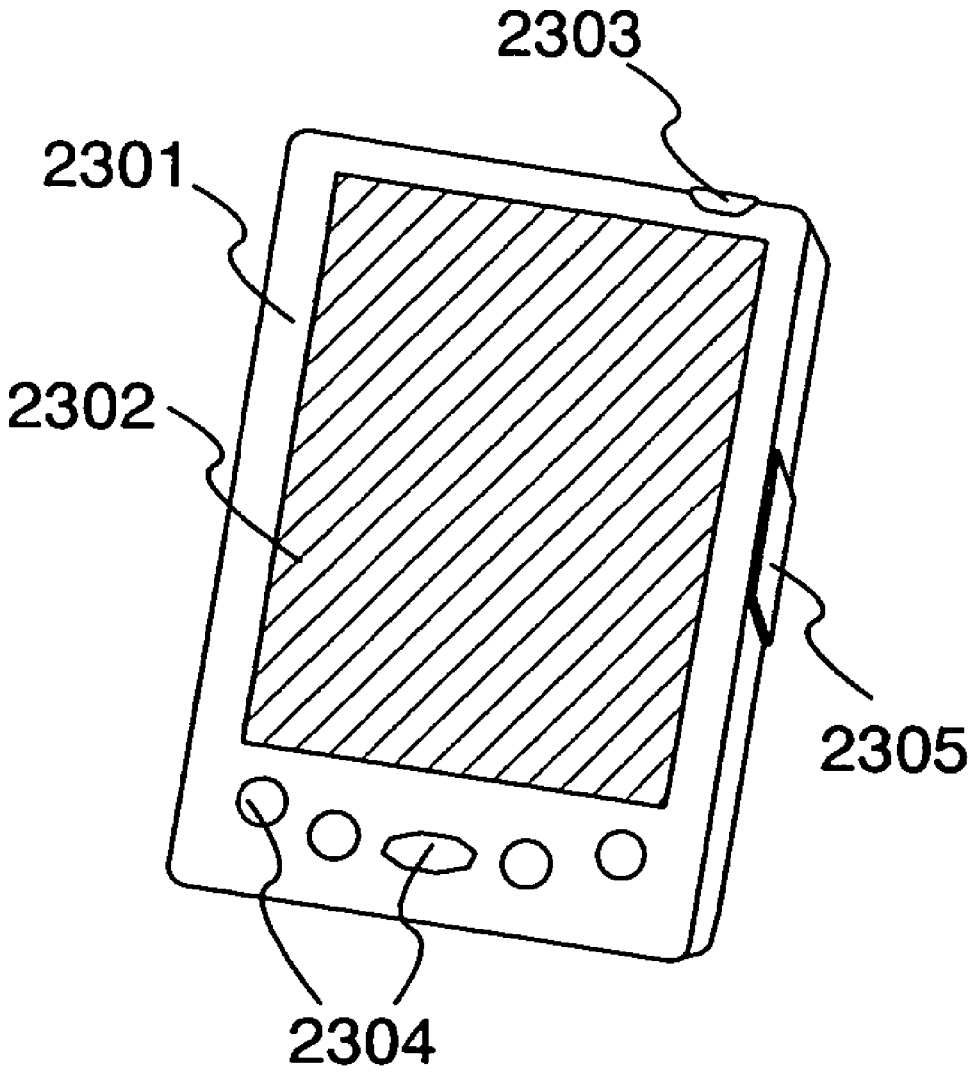
FIG. 18 shows a mobile computer of which display portion uses the invention.

FIG. 18 shows an example of the invention applied to a mobile computer that includes a main body 2301, a display portion 2302 using the display device of the invention, a switch 2303, operating keys 2304, an infrared port 2305, and the like. If a rechargeable battery is used, the power consumption of the display portion 2302 can be reduced and thus the battery can last a long time.

Embodiment 8

Figure 19:
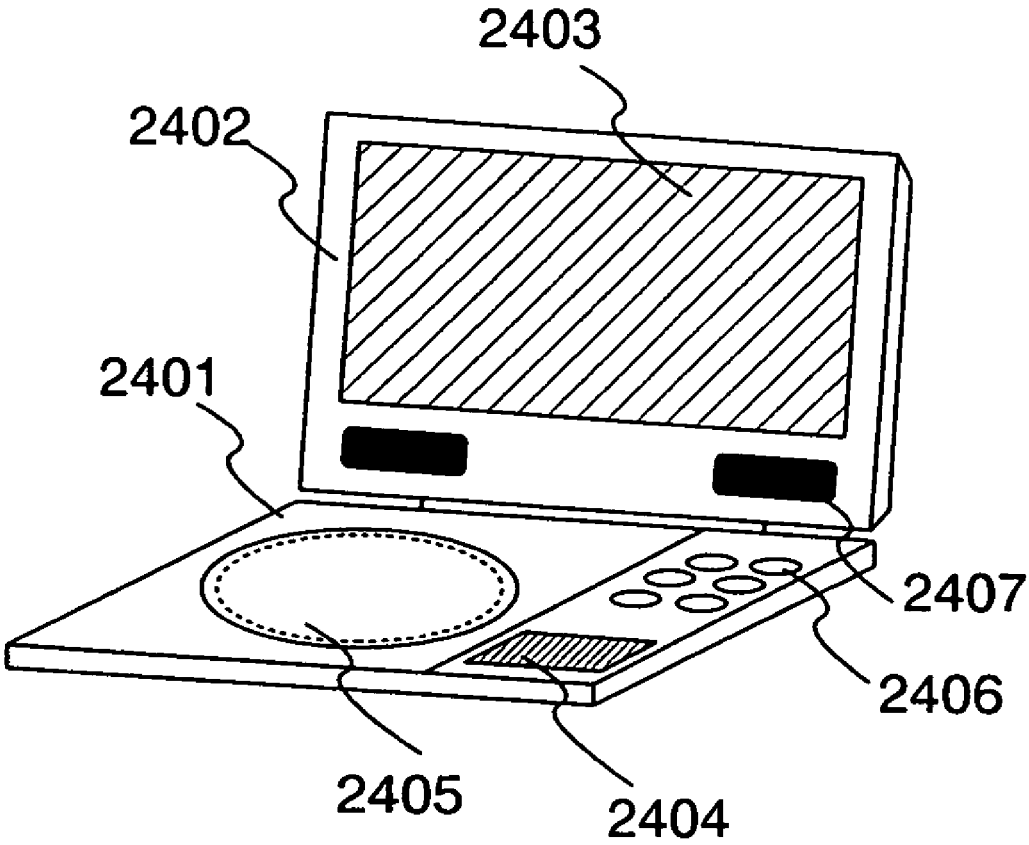
FIG. 19 shows a mobile image reproducing device of which display portion uses the invention.

FIG. 19 shows an example of the invention applied to a mobile image reproducing device provided with a recording medium (specifically, a DVD reproducing device), which includes a main body 2401, a housing 2402, a display portion A 2403 and a display portion B 2404 each using the display device of the invention, a recording medium (such as a DVD) reading portion 2405, an operating key 2406, a speaker portion 2407, and the like. The display portion A 2403 mainly displays image data whereas the display portion B 2404 mainly displays character data. The image reproducing device provided with a recording medium includes a home game machine and the like. By using the display device of the invention for the display portion A 2403 and the display portion B 2404, power consumption can be reduced.

Embodiment 9

Figure 20:
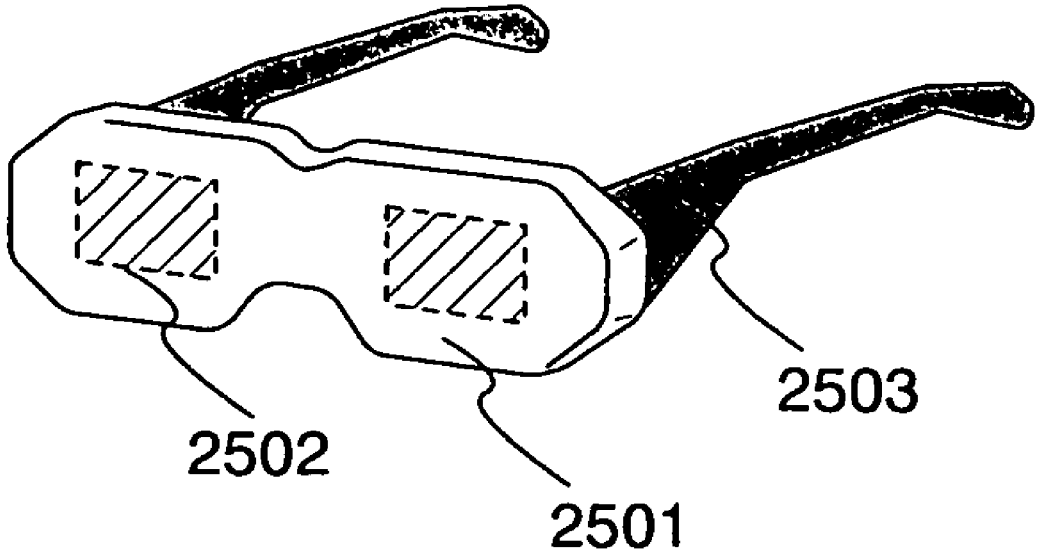
FIG. 20 shows a goggle type display of which display portion uses the invention.

FIG. 20 shows an example of the invention applied to a goggle type display (head mounted display) that includes a main body 2501, a display portion 2502 using the display device of the invention, an arm portion 2503, and the like. If a rechargeable battery is used, the power consumption of the display portion 2502 can be reduced and thus the battery can last a long time.

Embodiment 10

Figure 21:
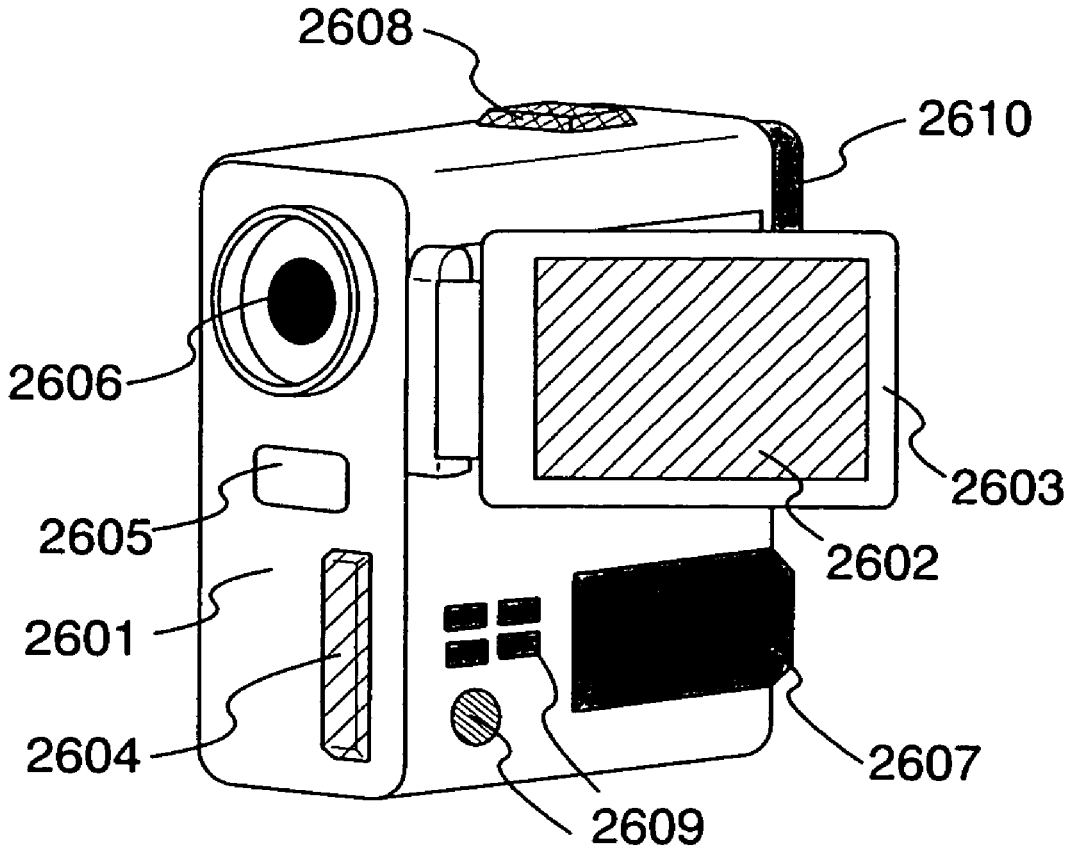
FIG. 21 shows a digital video camera of which display portion uses the invention.

FIG. 21 shows an example of the invention applied to a video camera that includes a main body 2601, a display portion 2602 using the display device of the invention, a housing 2603, an external connecting port 2604, a remote control receiving portion 2605, an image receiving portion 2606, a battery 2607, an audio input portion 2608, operating keys 2609, an eye piece portion 2610, and the like. The display device of the invention can also be used for the eye piece portion 2610. If a rechargeable battery is used, the power consumption of the display portion 2602 can be reduced and thus the battery can last a long time.

Embodiment 11

Figure 22:
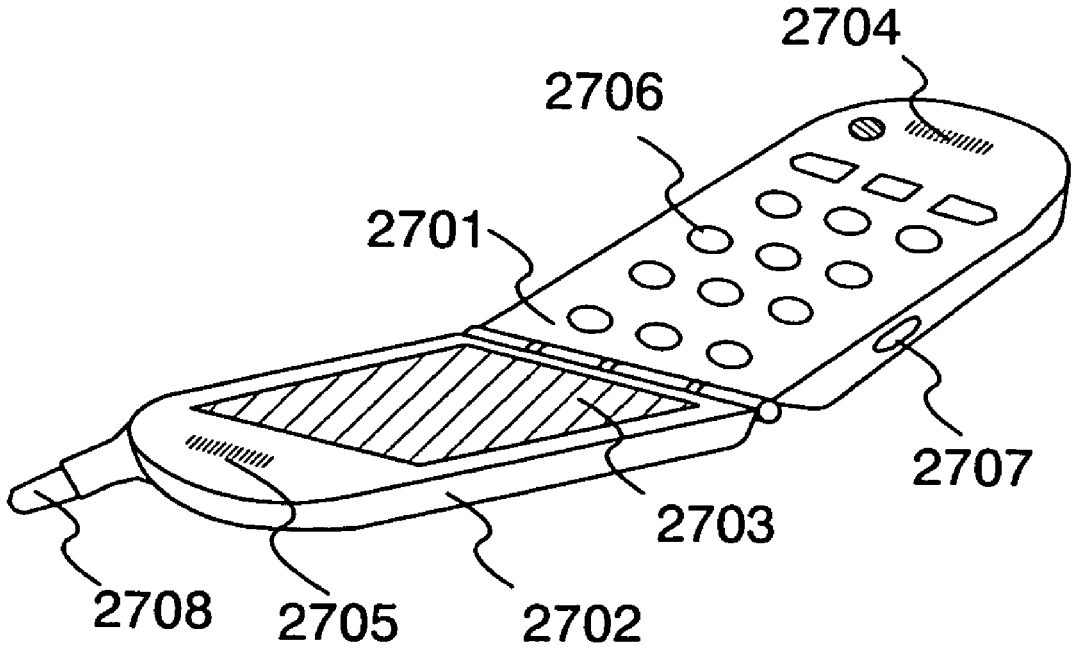
FIG. 22 shows a mobile phone of which display portion uses the invention.
Figure 23:
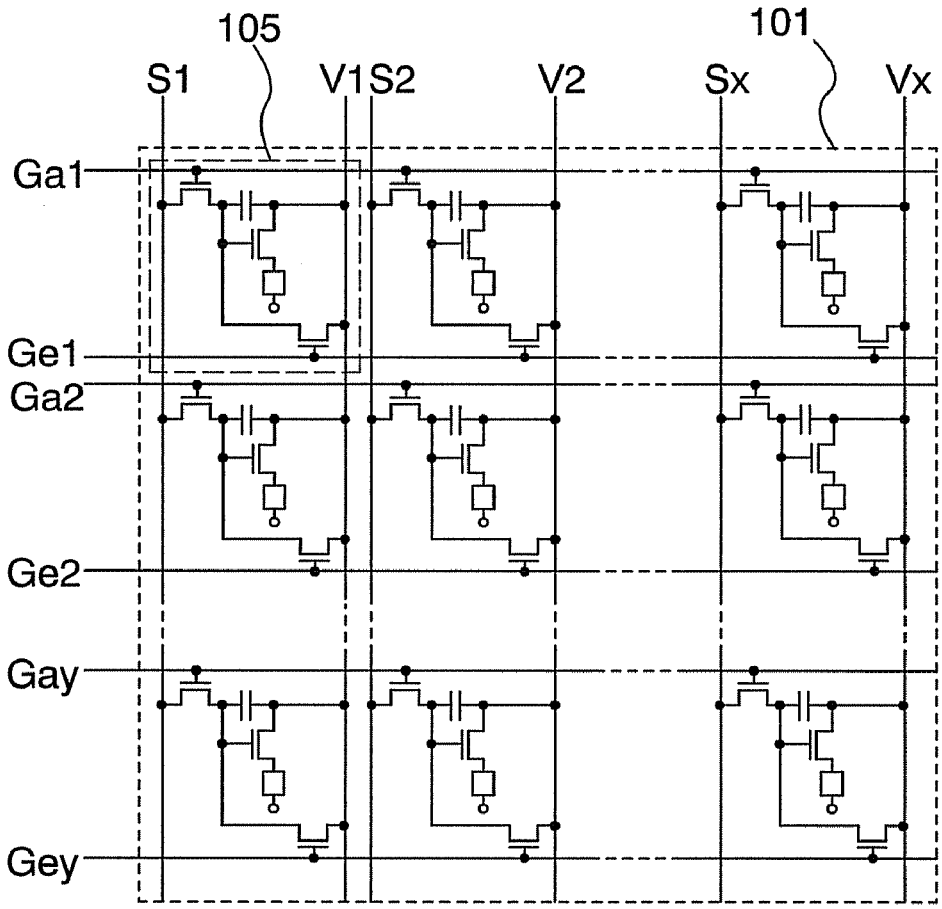
FIG. 23 is a circuit diagram of a pixel portion of a conventional display device.
Figure 24:
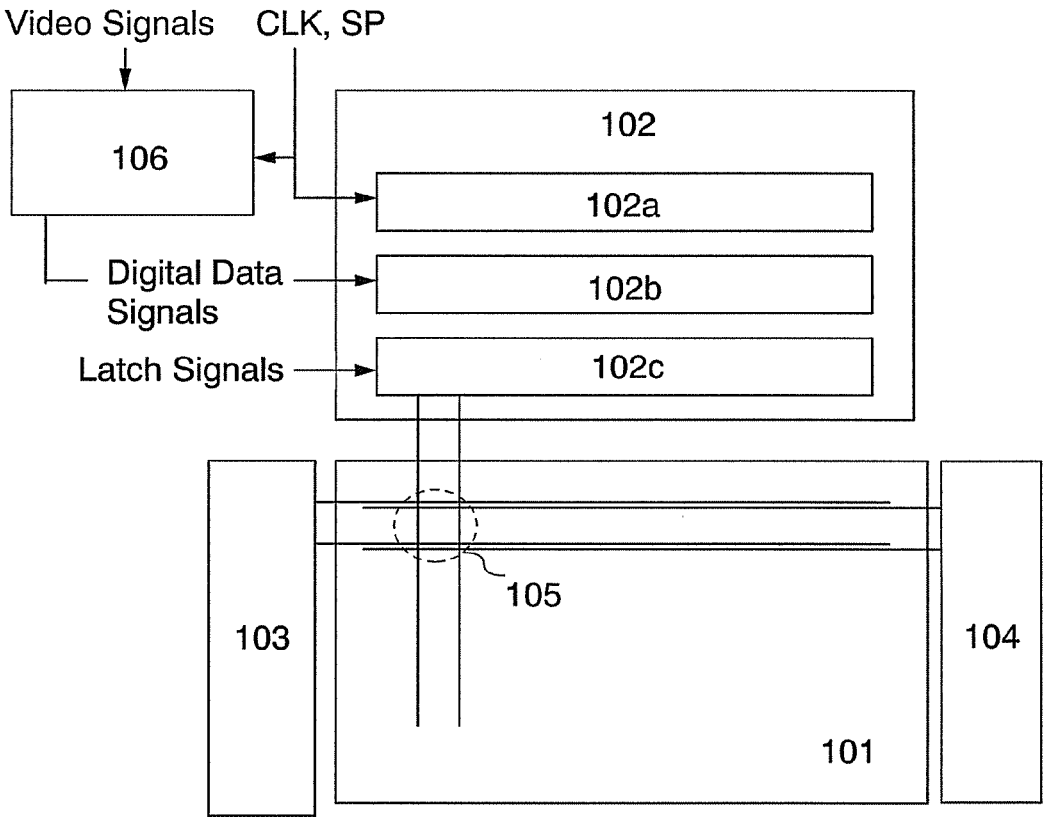
FIG. 24 is a diagram showing a circuit configuration of a conventional display device.
Figure 25:
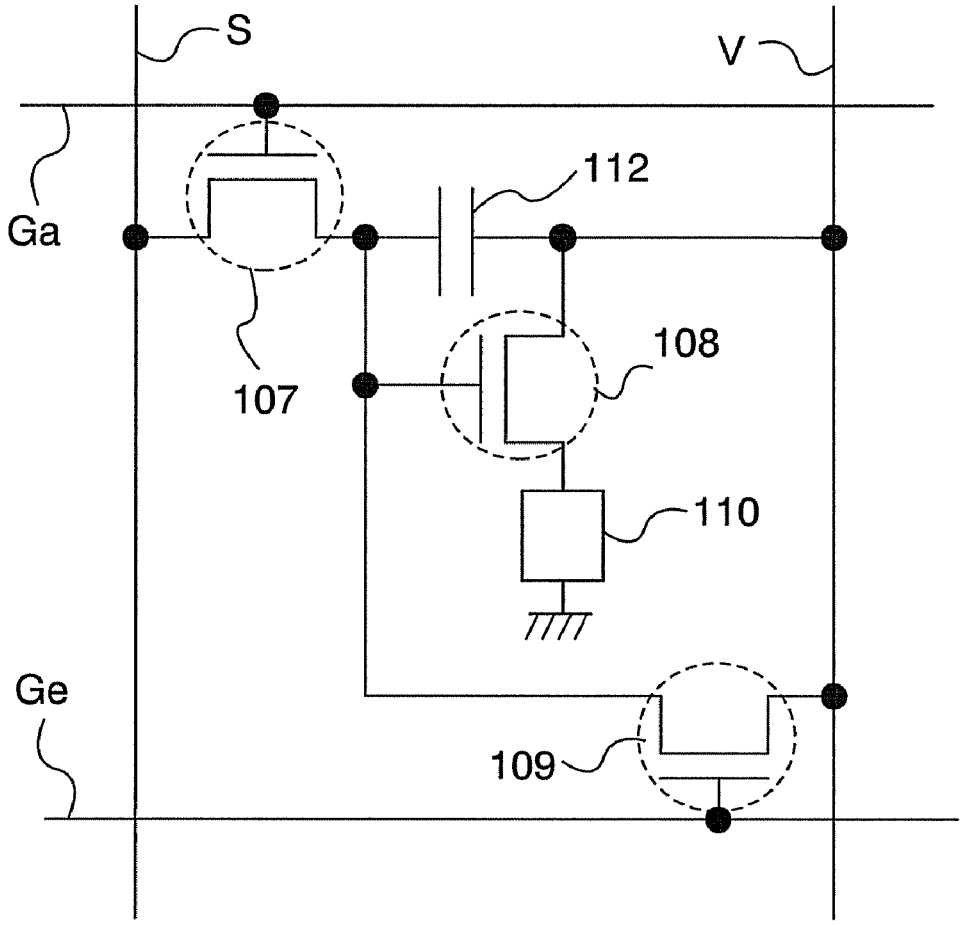
FIG. 25 is a circuit diagram of a pixel of a conventional display device.
Figure 26:
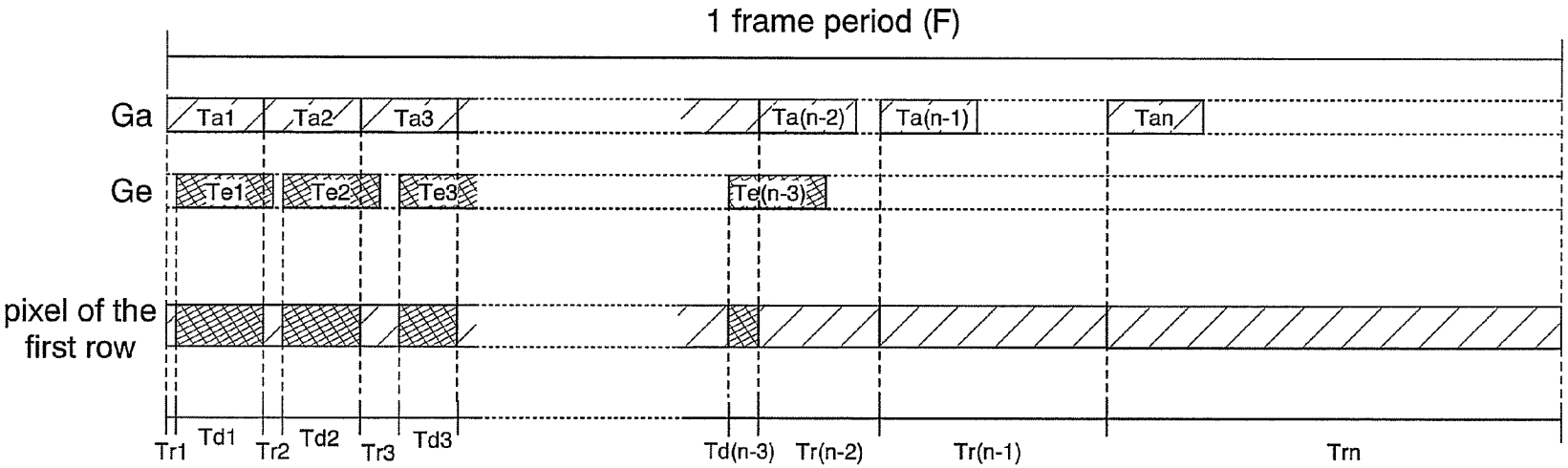
FIG. 26 is a diagram showing operations of a conventional display device.

FIG. 22 shows an example of the invention applied to a mobile phone that includes a main body 2701, a housing 2702, a display portion 2703 using the display device of the invention, an audio input portion 2704, an audio output portion 2705, an operation key 2706, an external connecting port 2707, an antenna 2708, and the like. If a rechargeable battery is used, the power consumption of the display portion 2703 can be reduced and thus the battery can last a long time.

As described above, each of the electronic apparatuses consumes less power by using the display device of the invention. In particular, a rechargeable battery can last a long time when the display device of the invention is used for a display portion of a mobile electronic apparatus.

This application is based on Japanese Patent Application serial No. 2004-119893 filed in Japan Patent Office on Apr. 15, 2004, the entire contents of which are hereby incorporated by reference.

What is claimed is:

1. A display device comprising:

an A/D converter for converting an analog video signal into a digital video signal and outputting the digital video signal;

a data controller for taking and processing the digital video signal and outputting the digital video signal to a display unit;

an average gray scale calculator obtaining an average gray scale by averaging a gray scale of each pixel over an entire screen of one frame based on the digital video signal from the A/D converter and for outputting an average gray scale signal;

a display time rate table outputting a magnification signal for reducing a display time rate when the average gray scale exceeds a certain value in accordance with the average gray scale signal; and a timing signal generator generating an erase start signal for erasing the digital video signal written to the each pixel of the display unit in accordance with the magnification signal.

2. The display device according to claim 1, wherein the each pixel comprises an EL element arranged in matrix.

3. The display device according to claim 1, wherein the each pixel comprises a liquid crystal element arranged in matrix.

4. The display device according to claim 1, wherein the display device is incorporated into an electronic apparatus selected from the group consisting of a video camera, a digital camera, a goggle type display, a navigation system, an audio reproducing device, a notebook computer, a game machine, a portable information terminal, and an image reproducing device.

5. A display device comprising:

an A/D converter for converting a analog video signal into a digital video signal and outputting the digital video signal;

a data controller for taking and processing the digital video signal, converting the digital video signal into the analog video signal, and outputting the analog video signal to a display unit;

an average gray scale calculator obtaining an average gray scale by averaging a gray scale of each pixel over an entire screen of one frame based on the digital video signal from the A/D converter and for outputting an average gray scale signal;

a display time rate table outputting a magnification signal for reducing a display time rate when the average gray scale exceeds a certain value in accordance with the average gray scale signal; and a timing signal generator generating an erase start signal for erasing the analog video signal written to the each pixel of the display unit in accordance with the magnification signal.

6. The display device according to claim 5, wherein the each pixel comprises an EL element arranged in matrix

7. The display device according to claim 5, wherein the each pixel comprises a liquid crystal element arranged in matrix.

8. The display device according to claim 5, wherein the display device is incorporated into an electronic apparatus selected from the group consisting of a video camera, a digital camera, a goggle type display, a navigation system, an audio reproducing device, a notebook computer, a game machine, a portable information terminal, and an image reproducing device.

9. A display device comprising:

an active matrix display unit comprising:

a source signal line driver circuit;

a first gate signal line driver circuit;

a second gate signal line driver circuit;

a pixel portion;

a plurality of source signal lines connected to the source signal line driver circuit;

a plurality of first gate signal lines connected to the first gate signal line driver circuit;

a plurality of second gate signal lines connected to the second gate signal line driver circuit; and a power supply line, wherein the pixel portion comprises a plurality of pixels, wherein each of the pixels comprises a switching transistor, an EL driving transistor, an erasing transistor, and an EL element, wherein a gate electrode of the switching transistor is connected to the first gate signal lines, wherein one of a source region and a drain region of the switching transistor is connected to the source signal lines and the other is connected to a gate electrode of the EL driving transistor, wherein a gate electrode of the erasing transistor is connected to the second gate signal lines, wherein one of a source region and a drain region of the erasing transistor is connected to the power supply line and the other is connected to the gate electrode of the EL driving transistor, wherein one of a source region and a drain region of the EL driving transistor is connected to the power supply line and the other is connected to the EL element, and a gray scale control circuit comprising:

an A/D converter for converting an analog video signal into a digital video signal and outputting the digital video signal;

a data controller for taking and processing the digital video signal and outputting the digital video signal to the active matrix display unit;

an average gray scale calculator obtaining an average gray scale by averaging a gray scale of each of the pixels over the entire screen of one frame based on the digital video signal from the A/D converter and for outputting an average gray scale signal;

a display time rate table outputting a magnification signal for reducing a display time rate when the average gray scale exceeds a certain value in accordance with the average gray scale signal; and a timing signal generator generating an erase start signal for erasing the digital video signal written to each of the pixels in accordance with the magnification signal, wherein the digital video signal written to each of the pixels is erased by supplying the erase start signal to the second gate signal line driver circuit.

10. The display device according to claim 9, wherein the display device is incorporated into an electronic apparatus selected from the group consisting of a video camera, a digital camera, a goggle type display, a navigation system, an audio reproducing device, a notebook computer, a game machine, a portable information terminal, and an image reproducing device.

11. A display device comprising:

an active matrix display unit comprising:

a source signal line driver circuit a gate signal line driver circuit;

a pixel portion;

a plurality of source signal lines connected to the source signal line driver circuit;

a plurality of gate signal lines connected to the gate signal line driver circuit; and a power supply line, wherein the pixel portion comprises a plurality of pixels, wherein each of the pixels comprises a switching transistor, an EL driving transistor, and an EL element, wherein a gate electrode of the switching transistor is connected to the gate signal lines, wherein one of a source region and a drain region of the switching transistor is connected to the source signal lines and the other is connected to a gate electrode of the EL driving transistor, wherein one of a source region and a drain region of the EL driving transistor is connected to the power supply line and the other is connected to the EL element, and a gray scale control circuit comprising:

an A/D converter for converting an analog video signal into a digital video signal and outputting the digital video signal;

a data controller for taking and processing the digital video signal, converting the digital video signal into the analog video signal, and outputting the analog video signal to the active matrix display unit;

an average gray scale calculator obtaining an average gray scale by averaging a gray scale of each of the pixels over the entire screen of one frame based on the digital video signal from the A/D converter and for outputting an average gray scale signal;

a display time rate table outputting a magnification signal for reducing a display time rate when the average gray scale exceeds a certain value in accordance with the average gray scale signal; and a timing signal generator generating an erase start signal for erasing the analog video signal written to each of the pixels in accordance with the magnification signal, wherein the analog video signal written to each of the pixels is erased by supplying the erase start signal to the gate signal line driver circuit.

12. The display device according to claim 11, wherein the display device is incorporated into an electronic apparatus selected from the group consisting of a video camera, a digital camera, a goggle type display, a navigation system, an audio reproducing device, a notebook computer, a game machine, a portable information terminal, and an image reproducing device.

* * * * *

UNITED STATES PATENT AND TRADEMARK OFFICE

CERTIFICATE OF CORRECTION

PATENT NO. : 7,460,137 B2
APPLICATION NO. : 11/100898
DATED : December 2, 2008
INVENTOR(S) : Keisuke Miyagawa It is certified that error appears in the above-identified patent and that said Letters Patent is hereby corrected as shown below:

Column 18, Claim 9, Line 38, Insert -- one of -- after -- connected to --.

Column 18, Claim 9, Line 40, Insert -- one of -- after -- connected to --.

Column 18, Claim 9, Line 44, Insert -- one of -- after -- connected to --.

Column 19, Claim 11, Line 31, Insert -- one of -- after -- connected to --.

Column 19, Claim 11, Line 33, Insert -- one of -- after -- connected to --.

Signed and Sealed this

Sixteenth Day of March, 2010

David J. Kappos

David J. Kappos
*Director of the United States Patent and Trademark Office*